US010332462B2

(12) United States Patent
Takahashi

(10) Patent No.: US 10,332,462 B2
(45) Date of Patent: Jun. 25, 2019

(54) SEMICONDUCTOR DEVICE, DISPLAY MODULE, AND ELECTRONIC DEVICE

(71) Applicant: Semiconductor Energy Laboratory Co., Ltd., Atsugi-shi, Kanagawa-ken (JP)

(72) Inventor: Kei Takahashi, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 15/672,980

(22) Filed: Aug. 9, 2017

(65) Prior Publication Data

US 2018/0053475 A1 Feb. 22, 2018

(30) Foreign Application Priority Data

Aug. 17, 2016 (JP) ..... 2016-159948

(51) Int. Cl.
*G09G 3/36* (2006.01)
*G09G 3/32* (2016.01)
(Continued)

(52) U.S. Cl.
CPC ..... *G09G 3/3607* (2013.01); *G09G 3/20* (2013.01); *G09G 3/32* (2013.01); *G09G 3/3225* (2013.01);
(Continued)

(58) Field of Classification Search
CPC ..... G09G 3/3607; G09G 3/3225; G09G 3/20; G09G 3/32; G09G 3/3611; G09G 2370/08;
(Continued)

(56) References Cited

U.S. PATENT DOCUMENTS 5,359,341 A 10/1994 Hutchings
5,550,066 A 8/1996 Tang et al.
(Continued)

FOREIGN PATENT DOCUMENTS

JP 09-081053 A 3/1997
JP 2000-259098 A 9/2000
(Continued)

OTHER PUBLICATIONS

Kusunoki.K et al., "Transmissive OLED and Reflective LC Hybrid (TR-Hybrid) Display", SID Digest '16 : SID International Symposium Digest of Technical Papers, May 22, 2016, vol. 47, pp. 57-60.
(Continued)

*Primary Examiner* — Premal R Patel
(74) *Attorney, Agent, or Firm* — Fish & Richardson P.C.

(57) ABSTRACT

A novel semiconductor device, display module, or electronic device is provided. The semiconductor device includes a controller, an image processing portion, a driver circuit, and an examination circuit. The controller has a function of controlling operations of the image processing portion and the examination circuit. The image processing portion has a function of generating a video signal using image data. The driver circuit has a function of outputting the video signal to a display portion. The examination circuit has a function of examining the degree of variations in characteristics of an element provided in the display portion. The examination results are output to the outside.

10 Claims, 25 Drawing Sheets

(51) Int. Cl.
*G09G 3/20* (2006.01)
*G09G 3/3225* (2016.01)

(52) U.S. Cl.
CPC ..... *G09G 3/3611* (2013.01); *G09G 2300/046* (2013.01); *G09G 2300/0426* (2013.01); *G09G 2320/0233* (2013.01); *G09G 2320/0295* (2013.01); *G09G 2370/08* (2013.01)

(58) Field of Classification Search
CPC ..... G09G 2320/0295; G09G 2300/046; G09G 2320/0233; G09G 2300/0426
See application file for complete search history.

(56) References Cited

U.S. PATENT DOCUMENTS

| | | | | |
|---|---|---|---|---|
| 5,581,160 | A | 12/1996 | Fujita | |
| 5,673,058 | A | 9/1997 | Uragami et al. | |
| 6,037,719 | A | 3/2000 | Yap et al. | |
| 6,048,573 | A | 4/2000 | Tang et al. | |
| 6,175,345 | B1 | 1/2001 | Kuribayashi et al. | |
| 6,229,506 | B1 | 5/2001 | Dawson et al. | |
| 6,362,798 | B1 | 3/2002 | Kimura et al. | |
| 6,373,455 | B1 | 4/2002 | Kuribayashi et al. | |
| 6,380,687 | B1 | 4/2002 | Yamazaki | |
| 6,538,374 | B2 | 3/2003 | Hosokawa | |
| 6,583,775 | B1 | 6/2003 | Sekiya et al. | |
| 6,611,130 | B2 | 8/2003 | Chang | |
| 6,653,996 | B2 | 11/2003 | Komiya | |
| 6,661,397 | B2 | 12/2003 | Mikami et al. | |
| 6,750,833 | B2 | 6/2004 | Kasai | |
| 6,777,888 | B2 | 8/2004 | Kondo | |
| 6,859,193 | B1 | 2/2005 | Yumoto | |
| 6,909,242 | B2 | 6/2005 | Kimura | |
| 6,933,672 | B2 | 8/2005 | Hosokawa | |
| 7,015,884 | B2 | 3/2006 | Kwon | |
| 7,148,884 | B2 | 12/2006 | Kasai | |
| 7,173,584 | B2 | 2/2007 | Kimura et al. | |
| 7,209,101 | B2 | 4/2007 | Abe | |
| 7,250,718 | B2 | 7/2007 | Hosokawa | |
| 7,324,101 | B2 | 1/2008 | Miyazawa | |
| 7,429,985 | B2 | 9/2008 | Kimura et al. | |
| 7,583,032 | B2 | 9/2009 | Kimura | |
| 7,915,830 | B2 | 3/2011 | Kimura | |
| 7,994,705 | B2 | 8/2011 | Hosokawa | |
| 8,487,841 | B2 | 7/2013 | Kimura et al. | |
| 8,896,506 | B2 | 11/2014 | Kimura et al. | |
| 2001/0009280 | A1 | 7/2001 | Tanaka et al. | |
| 2002/0070913 | A1 | 6/2002 | Kimura et al. | |
| 2006/0256047 | A1 | 11/2006 | Kimura et al. | |
| 2006/0290617 | A1 | 12/2006 | Miyazawa | |
| 2007/0139315 | A1 | 6/2007 | Abe | |
| 2008/0316152 | A1 | 12/2008 | Kimura et al. | |
| 2009/0009676 | A1 | 1/2009 | Kimura et al. | |
| 2010/0321364 | A1* | 12/2010 | Chang | G09G 3/3614 345/211 |
| 2011/0007067 | A1* | 1/2011 | Ryu | G09G 3/3233 345/214 |
| 2011/0169008 | A1 | 7/2011 | Kimura | |
| 2011/0260167 | A1 | 10/2011 | Hosokawa | |
| 2015/0340513 | A1 | 11/2015 | Akimoto et al. | |
| 2016/0086535 | A1 | 3/2016 | Kimura et al. | |
| 2017/0186372 | A1* | 6/2017 | Yanase | G09G 3/3233 |

FOREIGN PATENT DOCUMENTS

| | | | |
|---|---|---|---|
| JP | 2001-111053 | A | 4/2001 |
| JP | 2001-249627 | A | 9/2001 |
| JP | 2001-282137 | A | 10/2001 |
| JP | 2002-184575 | A | 6/2002 |
| JP | 2007-096055 | A | 4/2007 |
| JP | 2007-123861 | A | 5/2007 |
| JP | 2008-233933 | A | 10/2008 |
| WO | WO-2001/075852 | | 10/2001 |

OTHER PUBLICATIONS

Sakuishi.T et al., "Transmissive OLED and Reflective LC Hybrid (TR-Hybrid) Display with High Visibility and Low Power Consumption", SID Digest '16 : SID International Symposium Digest of Technical Papers, May 22, 2016, vol. 47, pp. 735-738.

Ohide.T et al., "Application of Transfer Technology to Manufacturing of Transmissive OLED and Reflective LC Hybrid (TR-Hybrid) Display", SID Digest '16 : SID International Symposium Digest of Technical Papers, May 22, 2016, vol. 47, pp. 1002-1004.

Baldo.M et al., "Highly Efficient Phosphorescent Emission From Organic Electroluminescent Devices", Nature, Sep. 10, 1998, vol. 395, pp. 151-154.

Baldo.M et al., "Very High-Efficiency Green Organic Light-Emitting Devices Based on Electrophosphorescence", Appl. Phys. Lett. (Applied Physics Letters) , Jul. 5, 1999, vol. 75, No. 1, pp. 4-6.

Tsutsui.T et al., "Electroluminescence in Organic Thin Films", Photochemical Processes in Organized Molecular Systems, 1991, pp. 437-450.

Tsutsui.T et al., "High Quantum Efficiency in Organic Light-Emitting Devices With Iridium-Complex As a Triplet Emissive Center", Jpn. J. Appl. Phys. (Japanese Journal of Applied Physics) , Dec. 15, 1999, vol. 38, No. 12B, pp. L1502-L1504.

* cited by examiner

SEMICONDUCTOR DEVICE, DISPLAY MODULE, AND ELECTRONIC DEVICE

BACKGROUND OF THE INVENTION

1. Field of the Invention

One embodiment of the present invention relates to a semiconductor device, a display module, and an electronic device.

Note that one embodiment of the present invention is not limited to the above technical field. Examples of the technical field of one embodiment of the present invention disclosed in this specification and the like include a semiconductor device, a display device, a light-emitting device, a power storage device, a memory device, a display module, a display system, an examination system, an electronic device, a lighting device, an input device, an input/output device, a driving method thereof, and a manufacturing method thereof.

In this specification and the like, a semiconductor device generally means a device that can function by utilizing semiconductor characteristics. A transistor, a semiconductor circuit, an arithmetic device, a driver circuit, a memory device, and the like are each one embodiment of the semiconductor device. In addition, an imaging device, an electro-optical device, a power generation device (e.g., a thin film solar cell and an organic thin film solar cell), and an electronic device may each include a semiconductor device.

2. Description of the Related Art

Flat panel displays typified by liquid crystal display devices and light-emitting display devices are widely used for displaying images. Although transistors used in these display devices are mainly manufactured using silicon semiconductors, attention has been drawn to a technique in which, instead of a silicon semiconductor, a metal oxide exhibiting semiconductor characteristics is used for transistors in recent years. For example, in Patent Documents 1 and 2, a technique is disclosed in which a transistor manufactured using zinc oxide or an In—Ga—Zn-based oxide for a semiconductor layer is used in a pixel of a display device.

In a display device including a light-emitting element, a driver transistor that controls current supplied to the light-emitting element in accordance with a video signal is provided. If the characteristics of the driver transistor vary among pixels, luminance of a light-emitting element varies among the pixels. In Patent Document 3, as a method for preventing such variation in luminance of light-emitting elements, a method for correcting variation in the threshold voltages of driver transistors in pixels (hereinafter also referred to as internal correction) is disclosed.

REFERENCES

Patent Documents

[Patent Document 1] Japanese Published Patent Application No. 2007-096055

[Patent Document 2] Japanese Published Patent Application No. 2007-123861

[Patent Document 3] Japanese Published Patent Application No. 2008-233933

SUMMARY OF THE INVENTION

An object of one embodiment of the present invention is to provide a novel semiconductor device, display module, or electronic device. Another object of one embodiment of the present invention is to provide a semiconductor device, a display module, or an electronic device that is capable of examining variations in element characteristics easily. Another object of one embodiment of the present invention is to provide a versatile semiconductor device, display module, or electronic device. Another object of one embodiment of the present invention is to provide a semiconductor device, a display module, or an electronic device that is capable of performing external correction with a high degree of freedom.

One embodiment of the present invention does not necessarily achieve all the objects listed above and only needs to achieve at least one of the objects. The description of the above objects does not preclude the existence of other objects. Other objects will be apparent from and can be derived from the description of the specification, the drawings, the claims, and the like.

A semiconductor device of one embodiment of the present invention includes a controller, an image processing portion, a driver circuit, and an examination circuit. The controller has a function of controlling operations of the image processing portion and the examination circuit. The image processing portion has a function of generating a video signal using image data. The driver circuit has a function of outputting the video signal to a display portion. The examination circuit has a function of examining the degree of variations in characteristics of an element provided in the display portion. The examination results are output to the outside.

In the semiconductor device of one embodiment of the present invention, the examination may be performed on the basis of a signal including information on the characteristics of the element provided in the display portion. The signal may be input from the display portion to the examination circuit.

In the semiconductor device of one embodiment of the present invention, the examination circuit may include a converter circuit, an evaluation circuit, and a memory device. The converter circuit may have a function of converting the signal into a digital signal. The evaluation circuit may have a function of calculating a difference between first element characteristics corresponding to the digital signal and second element characteristics used as a reference. The memory device may have a function of storing the first element characteristics, the second element characteristics, and data calculated by the evaluation circuit.

In the semiconductor device of one embodiment of the present invention, the controller may have a function of outputting the signal to a transmitting portion. The controller may have a function of outputting image data corrected by the transmitting portion on the basis of the signal to the image processing portion.

A display module of one embodiment of the present invention includes a control portion including the semiconductor device in any of the above embodiments and a display portion. The display portion includes a light-emitting element and a transistor electrically connected to the light-emitting element. The examination circuit has a function of examining the degree of variations in the threshold voltage of the transistor, the field-effect mobility of the transistor, or the threshold voltage of the light-emitting element.

In the display module of one embodiment of the present invention, the display portion may include a first pixel group including a plurality of first pixels and a second pixel group including a plurality of second pixels. The first pixel may include a reflective liquid crystal element and the second pixel may include the light-emitting element.

An electronic device of one embodiment of the present invention includes the display module and a processor. The processor has a function of correcting image data on the basis of the variations in the characteristics of the element provided in the display portion.

According to one embodiment of the present invention, a novel semiconductor device, display module, or electronic device can be provided. According to one embodiment of the present invention, a semiconductor device, a display module, or an electronic device that is capable of examining variations in element characteristics easily can be provided. According to one embodiment of the present invention, a versatile semiconductor device, display module, or electronic device can be provided. According to one embodiment of the present invention, a semiconductor device, a display module, or an electronic device that is capable of performing external correction with a high degree of freedom can be provided.

Note that the description of these effects does not preclude the existence of other effects. One embodiment of the present invention does not necessarily have all of the effects listed above. Other effects will be apparent from and can be derived from the description of the specification, the drawings, the claims, and the like.

DETAILED DESCRIPTION OF THE INVENTION

Figure 1A:
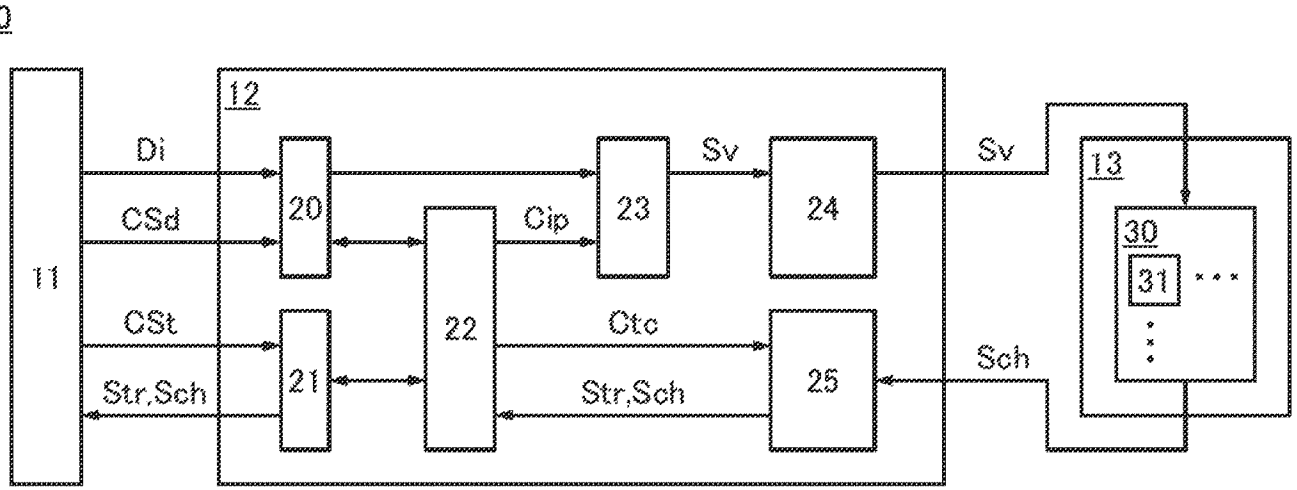
FIGS. 1A and 1B illustrate a configuration example of a system.

Embodiments of the present invention will be described below in detail with reference to the drawings. Note that the present invention is not limited to the following description and it is easily understood by those skilled in the art that the mode and details can be variously changed without departing from the scope and spirit of the present invention. Therefore, the present invention should not be interpreted as being limited to the description of the embodiments below.

One embodiment of the present invention includes, in its category, devices such as a semiconductor device, a memory device, a display device, an imaging device, and a radio frequency (RF) tag. Furthermore, the display device includes, in its category, a liquid crystal display device, a light-emitting device having pixels each provided with a light-emitting element typified by an organic light-emitting element, electronic paper, a digital micromirror device (DMD), a plasma display panel (PDP), a field emission display (FED), and the like.

In this specification and the like, a metal oxide means an oxide of metal in a broad sense. Metal oxides are classified into an oxide insulator, an oxide conductor (including a transparent oxide conductor), an oxide semiconductor (also simply referred to as an OS), and the like. For example, a metal oxide used in a channel formation region of a transistor is called an oxide semiconductor in some cases. That is, a metal oxide that has at least one of an amplifying function, a rectifying function, and a switching function can be called a metal oxide semiconductor, or OS for short. In the following description, a transistor including a metal oxide in a channel formation region is also called an OS transistor.

In this specification and the like, a metal oxide including nitrogen is also called a metal oxide in some cases. Moreover, a metal oxide including nitrogen may be called a metal oxynitride. The details of a metal oxide are described later.

Furthermore, in this specification and the like, an explicit description "X and Y are connected" means that X and Y are electrically connected, X and Y are functionally connected, and X and Y are directly connected. Accordingly, without being limited to a predetermined connection relation, for example, a connection relation shown in drawings or text, another connection relation is included in the drawings or the text. Here, X and Y each denote an object (e.g., a device, an element, a circuit, a wiring, an electrode, a terminal, a conductive film, or a layer).

Examples of the case where X and Y are directly connected include the case where an element that allows an electrical connection between X and Y (e.g., a switch, a transistor, a capacitor, an inductor, a resistor, a diode, a display element, a light-emitting element, and a load) is not connected between X and Y, and the case where X and Y are connected without the element that allows the electrical connection between X and Y provided therebetween.

For example, in the case where X and Y are electrically connected, one or more elements that enable an electrical connection between X and Y (e.g., a switch, a transistor, a capacitor, an inductor, a resistor, a diode, a display element, a light-emitting element, or a load) can be connected between X and Y. Note that the switch is controlled to be turned on or off. That is, a switch is conducting or not conducting (is turned on or off) to determine whether current flows therethrough or not. Alternatively, the switch has a function of selecting and changing a current path. Note that the case where X and Y are electrically connected includes the case where X and Y are directly connected.

For example, in the case where X and Y are functionally connected, one or more circuits that enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power source circuit (e.g., a step-up circuit or a step-down circuit) or a level shifter circuit for changing the potential level of a signal, a voltage source; a current source; a switching circuit; an amplifier circuit such as a circuit that can increase signal amplitude, the amount of current, or the like, an operational amplifier, a differential amplifier circuit, a source follower circuit, or a buffer circuit; a signal generation circuit; a memory circuit; and/or a control circuit) can be connected between X and Y. For example, even when another circuit is interposed between X and Y, X and Y are functionally connected if a signal output from X is transmitted to Y. Note that the case where X and Y are functionally connected includes the case where X and Y are directly connected and the case where X and Y are electrically connected.

Note that in this specification and the like, an explicit description "X and Y are electrically connected" means that X and Y are electrically connected (i.e., the case where X and Y are connected with another element or another circuit provided therebetween), X and Y are functionally connected (i.e., the case where X and Y are functionally connected with another circuit provided therebetween), and X and Y are directly connected (i.e., the case where X and Y are connected without another element or another circuit provided therebetween). That is, in this specification and the like, the explicit description "X and Y are electrically connected" is the same as the description "X and Y are connected".

Even when independent components are electrically connected to each other in the drawing, one component has functions of a plurality of components in some cases. For example, when part of a wiring also functions as an electrode, one conductive film functions as the wiring and the electrode. Thus, "electrical connection" in this specification includes in its category such a case where one conductive film has functions of a plurality of components.

Embodiment 1

In this embodiment, a semiconductor device and a system, each of which is one embodiment of the present invention, are described.

<Configuration Example of System>

FIG. 1A illustrates a configuration example of a system 10. The system 10 includes a transmitting portion 11, a control portion 12, and a display portion 13. The system 10 has a function of generating a signal for displaying an image on the basis of data transmitted from the transmitting portion 11 (hereinafter this signal is also referred to as a video signal) and displaying an image on the basis of the video signal. The system 10 also has a function of examining characteristics of an element used for displaying an image. That is, the system 10 functions as both a display system and an examination system.

The transmitting portion 11 has a function of transmitting data Di (hereinafter also referred to as image data) corresponding to an image displayed on the display portion 13 and a control signal (a signal CSd) for controlling display of an image to the control portion 12. In addition, the transmitting portion 11 has a function of transmitting a control signal (a signal CSt) for controlling examination of element characteristics to the control portion 12.

The transmitting portion 11 corresponds to a host that instructs the control portion 12 to execute examination of display of an image or element characteristics. The transmitting portion 11 can be formed using a processor or the like.

The control portion 12 has a function of generating a video signal on the basis of the data Di input from the transmitting portion 11 and outputting the video signal to the display portion 13. The control portion 12 also has a function of examining characteristics of an element used for displaying an image and outputting examination results to the transmitting portion 11. The control portion 12 includes an interface 20, an interface 21, a controller 22, an image processing portion 23, a driver circuit 24, and an examination circuit 25.

Note that the control portion 12 can be formed using a semiconductor device. Thus, the control portion 12 can also be referred to as a semiconductor device. The circuits included in the control portion 12 can be integrated into one integrated circuit.

The interface 20 and the interface 21 each have a function of transmitting and receiving a signal to and from the transmitting portion 11. The data Di input from the transmitting portion 11 is output to the image processing portion 23 via the interface 20, and the signal CSd input from the transmitting portion 11 is output to the controller 22 via the interface 20. The signal CSt input from the transmitting portion 11 is output to the controller 22 via the interface 21. Signals are transmitted from the control portion 12 to the transmitting portion 11 via the interface 20 or the interface 21.

The controller 22 has a function of controlling operations of the circuits included in the control portion 12 on the basis of the signals input from the transmitting portion 11. Specifically, the controller 22 has a function of generating a signal Cip for controlling the operation of the image processing portion 23 on the basis of the signal CSd input from the transmitting portion 11 via the interface 20 and outputting the signal Cip to the image processing portion 23. In addition, the controller 22 has a function of generating a signal Ctc for controlling the operation of the examination circuit 25 on the basis of the signal CSt input from the transmitting portion 11 via the interface 21 and outputting the signal Ctc to the examination circuit 25.

The image processing portion 23 has a function of generating a video signal using the image data. Specifically, the image processing portion 23 has a function of generating a signal Sv by performing various kinds of processing on the data Di input from the transmitting portion 11 and transmitting the signal Sv to the driver circuit 24. Examples of the processing performed in the image processing portion 23 include gamma correction, dimming, and toning.

The driver circuit 24 has a function of performing signal processing on the video signal as appropriate and outputting the processed signal to the display portion 13. Specifically, the driver circuit 24 has a function of performing processing such as a level shift and digital-to-analog (DA) conversion on the signal Sv input from the image processing portion 23 and transmitting the processed signal Sv to the display portion 13. Note that the driver circuit 24 may be provided in the display portion 13.

The display portion 13 includes a pixel portion 30 including a plurality of pixels 31. When the signal Sv is input to the pixel portion 30, an image corresponding to the signal Sv is displayed.

Figure 1B:
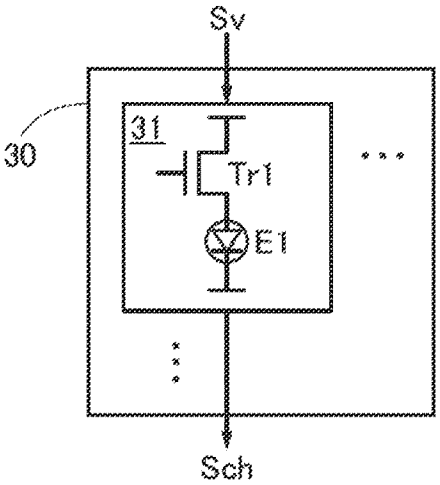

The pixel 31 includes a light-emitting element and a transistor having a function of controlling luminance of the light-emitting element. FIG. 1B illustrates a configuration example of the pixel 31 including a light-emitting element E1 and a transistor Tr1 connected to the light-emitting element E1. The transistor Tr1 has a function of controlling the amount of current flowing through the light-emitting element E1. The luminance of the light-emitting element E1 can be controlled by controlling the amount of current flowing through the light-emitting element E1; thus, the pixel 31 can display a predetermined gray level.

As the light-emitting element E1, for example, a self-luminous light-emitting element such as an organic light-emitting diode (OLED), a light-emitting diode (LED), a quantum-dot light-emitting diode (QLED), and a semiconductor laser can be used.

Note that an image displayed on the display portion 13 is affected by variations in the characteristics of the elements (e.g., the transistor Tr1 and the light-emitting element E1) included in the pixel 31. Thus, in order to control the quality of the image displayed on the display portion 13, the degree of the variations in the characteristics of the elements included in the pixel 31 needs to be understood.

Note that the control portion 12 of one embodiment of the present invention has a function of examining the degree of the variations in the characteristics of the elements included in the pixel 31 on the basis of a signal Sch including information on the characteristics of the elements (e.g., the transistor Tr1 and the light-emitting element E1) included in the pixel 31. Then, a signal Str corresponding to the results of the examination with the control portion 12 is output from the control portion 12 to the transmitting portion 11. Accordingly, the transmitting portion 11 can understand the degree of the variations in the characteristics of the elements included in the pixel 31.

In addition, the control portion 12 of one embodiment of the present invention has a function of outputting the signal Sch to the transmitting portion 11. The transmitting portion 11 has a function of correcting the data Di transmitted to the control portion 12 on the basis of the variations in the element characteristics indicated by the signal Sch. Accordingly, even when the characteristics of the elements included in the pixel 31 vary, an image can be correctly displayed on the display portion 13.

The element characteristics are examined when the signal Sch is input from the pixel 31 to the examination circuit 25 included in the control portion 12. Note that current flowing through the pixel 31, voltage output from the pixel 31, or the like can be used as the signal Sch when the predetermined signal Sv is supplied to the pixel 31.

The examination circuit 25 has a function of examining the degree of the variations in the element characteristics on the basis of the signal Sch. Specifically, the examination circuit 25 has a function of calculating the degree of the variations in the element characteristics on the basis of the signal Sch output from the pixel 31 when the predetermined signal Sv is supplied to the pixel 31 and outputting the calculation results as the signal Str to the controller 22. The signal Str input to the controller 22 is output to the transmitting portion 11 via the interface 21. Accordingly, the transmitting portion 11 can understand the degree of the variations in the element characteristics and determine whether the data Di needs to be corrected or not.

The signal Str can include information such as ranks of elements classified on the basis of deviation from ideal characteristics of the transistor Tr1 and the number of elements belonging to the ranks. From the above-described information, the degree of the variations in the element characteristics can be understood.

The examination circuit 25 has a function of outputting the signal Sch to the controller 22. The signal Sch input to the controller 22 is output to the transmitting portion 11 via the interface 21. In the case where the correction of the data Di is determined to be necessary by the examination, the transmitting portion 11 corrects the data Di on the basis of the signal Sch. The corrected data Di is transmitted to the control portion 12 and a video signal is generated using the data Di. Accordingly, a video signal taking the variations in the element characteristics into account can be generated and the quality of the image displayed on the display portion 13 can be improved, so that a highly reliable display system can be achieved.

Note that the operation of the examination circuit 25 is controlled by the signal Ctc generated by the controller 22 on the basis of the signal CSt. Thus, when the predetermined control signal is input to the control portion 12, the transmitting portion 11 can receive the examination results from the control portion 12.

As described above, the control portion 12 of one embodiment of the present invention includes the examination circuit 25 as well as the image processing portion 23, the driver circuit 24, and the like used for displaying an image. Thus, when the predetermined control signal is input to the control portion 12, information on the element characteristics of the display portion 13 can be easily obtained.

In the case where internal correction is performed in the pixel 31, the number of elements included in the pixel 31 is increased; thus, the area of the pixel 31 is also increased. The internal correction is a method in which correction is performed inside the pixel 31; thus, it is difficult to control the content of the correction from the outside and the content of the correction may be limited. In contrast, in one embodiment of the present invention, the transmitting portion 11 receives the signal Sch output from the control portion 12, so that the correction based on the variations in the element characteristics can be freely performed outside the pixel 31. That is, external correction with a high degree of freedom can be performed. Accordingly, a wide range of content can be corrected while an increase in the area of the pixel 31 is suppressed.

<Configuration Example of Examination Circuit>

Figure 2A:
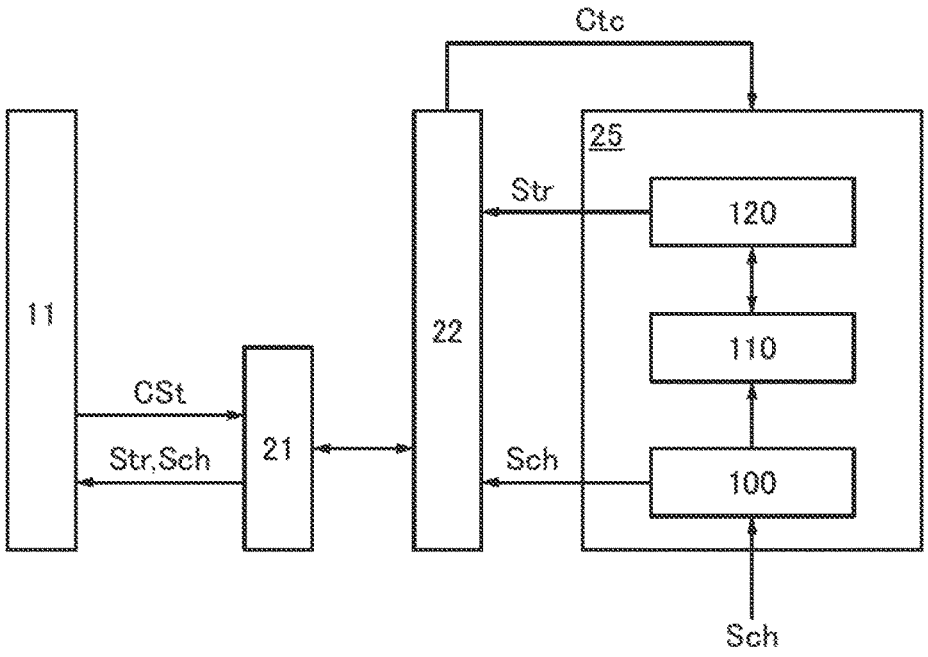
FIGS. 2A to 2C illustrate a configuration example of an examination circuit.

FIG. 2A illustrates a configuration example of the examination circuit 25. The examination circuit 25 includes a converter circuit 100, an evaluation circuit 110, and a memory device 120. Operations of the converter circuit 100, the evaluation circuit 110, and the memory device 120 are controlled by the signal Ctc input from the controller 22.

The converter circuit 100 has a function of converting the signal Sch into a predetermined signal and outputting the converted signal to the controller 22 or the evaluation circuit 110. The converter circuit 100 has a function of, for example, performing analog-to-digital (AD) conversion on the signal Sch.

Figure 2B:
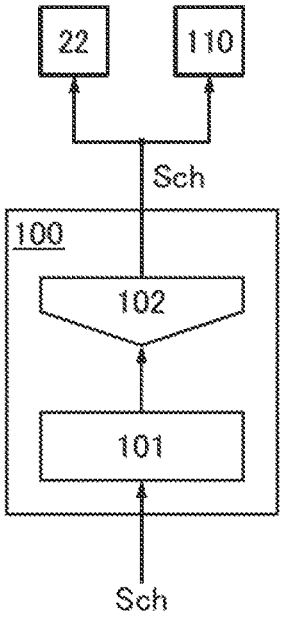
Figure 3A:
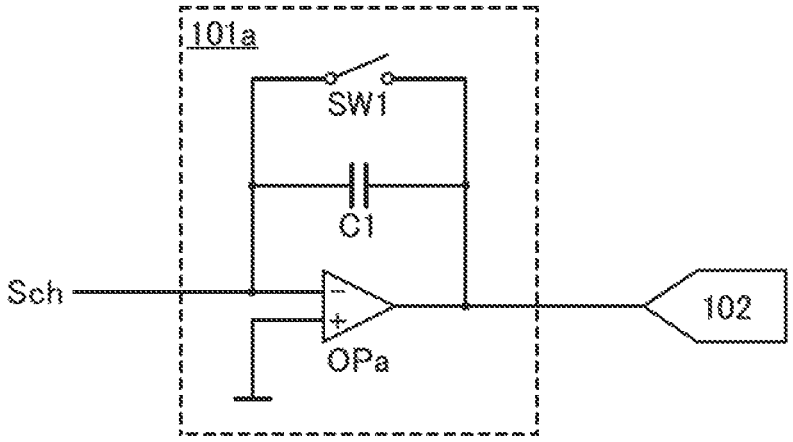
FIGS. 3A to 3C each illustrate a configuration example of a read circuit.
Figure 3B:
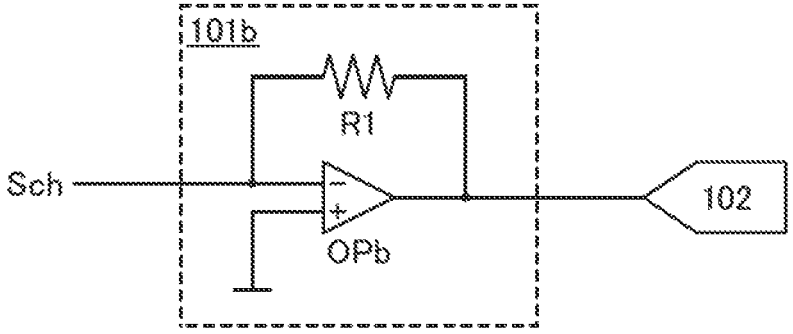
Figure 3C:
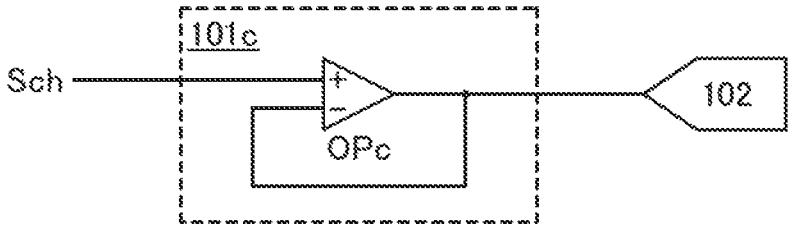

FIG. 2B illustrates a specific configuration example of the converter circuit 100. The converter circuit 100 includes a read circuit 101 and an AD converter circuit 102. The read circuit 101 has a function of converting or amplifying the signal Sch, for example. The read circuit 101 can be omitted. FIGS. 3A to 3C each illustrate a configuration example of the read circuit.

When current is supplied as the signal Sch from the pixel 31, a read circuit 101*a* illustrated in FIG. 3A has a function of outputting an integral value of the current. The read circuit 101*a* includes an operational amplifier OPa, a capacitor C1, and a switch SW1.

A reference potential is input to a non-inverting input terminal of the operational amplifier OPa, and the signal Sch is input to an inverting input terminal of the operational amplifier OPa. The inverting input terminal of the operational amplifier OPa is connected to one terminal of the switch SW1 and one electrode of the capacitor C1, and an output terminal of the operational amplifier OPa is connected to the other terminal of the switch SW1 and the other electrode of the capacitor C1. Thus, an integrator circuit is formed, and the read circuit 101*a* can output a potential corresponding to the integral value of the current input as the signal Sch to the AD converter circuit 102.

When current is supplied as the signal Sch from the pixel 31, a read circuit 101*b* illustrated in FIG. 3B has a function of converting the current into voltage and outputting the voltage. The read circuit 101*b* includes an operational amplifier OPb and a resistor R1.

A reference potential is input to a non-inverting input terminal of the operational amplifier OPb, and the signal Sch is input to an inverting input terminal of the operational amplifier OPb. An output terminal of the operational amplifier OPb is connected to the inverting input terminal through the resistor R1. Thus, the read circuit 101*b* can output a potential corresponding to the value of the current input as the signal Sch to the AD converter circuit 102.

When a potential is supplied as the signal Sch from the pixel 31, a read circuit 101*c* illustrated in FIG. 3C has a function of amplifying and outputting the potential. The read circuit 101*c* includes an operational amplifier OPc.

The signal Sch is input to a non-inverting input terminal of the operational amplifier OPc. An output terminal of the operational amplifier OPc is connected to an inverting input terminal. Thus, the read circuit 101*c* can amplify and output the potential input as the signal Sch to the AD converter circuit 102.

The AD converter circuit 102 has a function of converting the signal Sch input as an analog signal into a digital signal and outputting the digital signal to the controller 22 or the evaluation circuit 110. The signal Sch input as the analog signal may be either current or voltage.

Figure 2C:
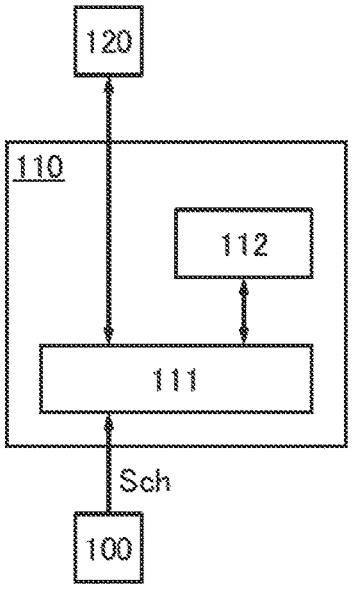

The evaluation circuit 110 has a function of calculating the degree of the variations in the element characteristics. Specifically, the evaluation circuit 110 has a function of comparing element characteristics corresponding to the signal Sch input from the converter circuit 100 with reference element characteristics and calculating a difference therebetween. FIG. 2C illustrates a specific configuration example of the evaluation circuit 110. The evaluation circuit 110 illustrated in FIG. 2C includes an arithmetic circuit 111 and a register 112.

The arithmetic circuit 111 has a function of performing arithmetic operation for evaluating the element characteristics. Specifically, the arithmetic circuit 111 has a function of reading out the reference element characteristics and the element characteristics corresponding to the signal Sch by accessing the memory device 120 and comparing these element characteristics with each other to calculate the difference therebetween. In addition, the arithmetic circuit 111 has a function of ranking the elements on the basis of the calculated difference between the element characteristics and storing the calculation results in the memory device 120. Note that as the reference element characteristics used for the arithmetic operation, ideal characteristics for the elements included in the pixel 31 can be used, for example.

The register 112 is connected to the arithmetic circuit 111 and has a function of temporarily holding data used for the arithmetic operation in the arithmetic circuit 111.

The memory device 120 has a function of storing data used for the evaluation of the element characteristics. Specifically, the memory device 120 has a function of storing the reference element characteristics, a table showing a relationship between the signal Sch and the element characteristics, the evaluation results of the element characteristics calculated by the arithmetic circuit 111, and the like. The evaluation results of the element characteristics stored in the memory device 120 are output as the signal Str to the controller 22.

Examples of the element characteristics stored in the memory device 120 include the field-effect mobility and the threshold voltage of the transistor Tr1 illustrated in FIG. 1B and the threshold voltage of the light-emitting element E1 illustrated in FIG. 1B. Note that the element characteristics stored in the memory device 120 can be rewritten using the controller 22. Examples of the evaluation results of the element characteristics stored in the memory device 120 include the ranks of the elements calculated by the arithmetic circuit 111 and the number of elements belonging to the ranks.

The signal Sch output from the converter circuit 100 to the controller 22 and the signal Str output from the memory device 120 to the controller 22 are output to the transmitting portion 11 via the interface 21. Accordingly, the transmitting portion 11 can obtain the examination results of the element characteristics and the information on the element characteristics.

<Operation Example of System>

Next, an operation example of the system 10 is described. The system 10 functions as an examination system 10*a* examining element characteristics, and also functions as a display system 10*b* displaying an image using image data corrected on the basis of variations in the element characteristics. An operation example of each of the systems is described below.

[Examination System]

Figure 4:
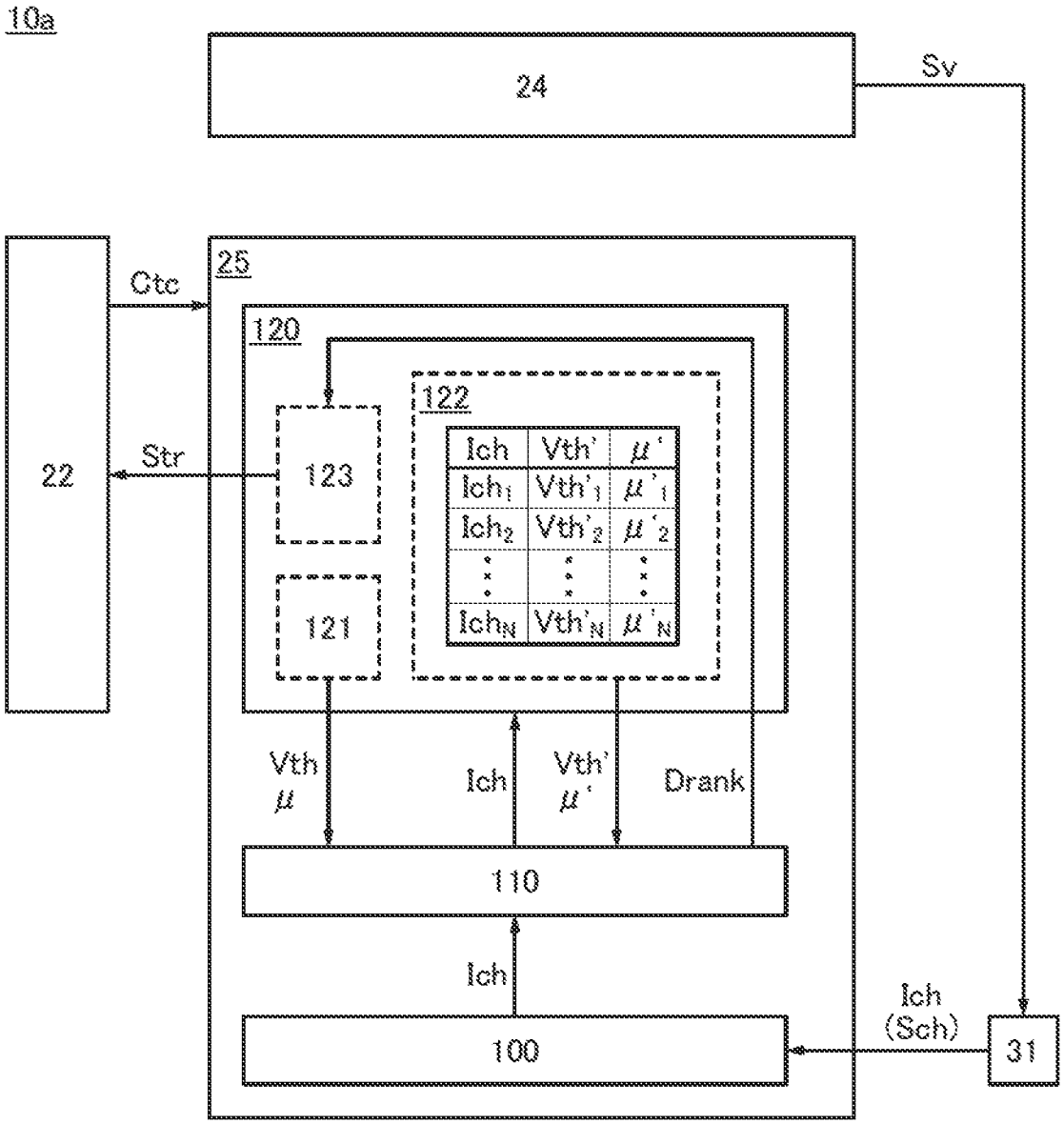
FIG. 4 illustrates an operation example of a system.

FIG. 4 illustrates an operation example of the examination system 10*a*. Here, the case where current Ich is read out as the signal Sch from the pixel 31 and variations in the threshold voltage and field-effect mobility of the transistor Tr1 illustrated in FIG. 1B are examined is described as an example.

First, the signal Sv is supplied from the driver circuit 24 to the pixel 31, and the current Ich flowing through the transistor Tr1 at this time is input to the converter circuit 100. Then, the current Ich is converted into a digital signal and input to the evaluation circuit 110.

Next, the evaluation circuit 110 accesses the memory device 120 to read out data and calculates the variations in the element characteristics. Note that the memory device 120 includes a region 121, a region 122, and a region 123. In the region 121, reference threshold voltage $V_{th}$ and reference field-effect mobility μ are stored. The reference threshold voltage $V_{th}$ and the reference field-effect mobility μ are ideal threshold voltage and ideal field-effect mobility for the transistor Tr1, respectively. In the region 122. N threshold voltages $V_{th}'$ ($V_{th}'_1$ to $V_{th}'_N$) and N field-effect mobility μ' ($\mu'_1$ to $\mu'_N$) of N transistors Tr1 that correspond to N currents Ich ($Ich_1$ to $Ich_N$) are stored. Note that N is a natural number.

First, the evaluation circuit 110 accesses the region 121 to read out the reference field-effect mobility μ and the reference threshold voltage $V_{th}$ from the memory device 120. In addition, the evaluation circuit 110 outputs the currents Ich to the memory device 120 and reads out the field-effect mobility μ' and the threshold voltages $V_{th}'$ that correspond to the currents Ich from the region 122. Then, $\Delta V_{th}$ that is an error between $V_{th}$ and $V_{th}'$ and Δμ that is an error between μ and μ' are calculated and ranks of the elements are determined on the basis of the errors. After that, data Drank corresponding to the results of the ranking is stored in the region 123.

A method for ranking the elements can be freely determined without any particular limitation. For example, as shown in Table 1, the elements can be classified into Rank A to Rank F on the basis of ranges of $\Delta V_{th}$ and Δμ. Here, the elements are classified into six ranks; Rank A is the highest rank and Rank F is the lowest rank. Furthermore, the transistor Tr1 classified into Rank F cannot be corrected. Note that criterion values of $\Delta V_{th}$ and Δμ for judging impossibility of correction are determined by a dynamic range of the driver circuit 24 generating the signal Sv, for example.

TABLE 1

| Rank | ΔVth | Δ μ |
|---|---|---|
| A | \| ΔVth \| ≤ 0.10 V | \| Δ μ \| ≤ 10% |
| B | 0.10 V < \| ΔVth \| ≤ 0.25 V | 10% < \| Δ μ \| ≤ 25% |
| C | 0.25 V < \| ΔVth \| ≤ 0.50 V | 25% < \| Δ μ \| ≤ 50% |
| D | 0.50 V < \| ΔVth \| ≤ 1.00 V | 50% < \| Δ μ \| ≤ 100% |
| E | 1.00 V < \| ΔVth \| ≤ 2.00 V | 100% < \| Δ μ \| ≤ 200% |
| F | \| ΔVth \| > 2.00 V | \| Δ μ \| > 200% |

In the region 123, the data Drank and data corresponding to the number of elements classified into different ranks are stored. These pieces of data are output as the signal Str to the controller 22 and then output to the transmitting portion 11 via the interface 21 (see FIG. 2A). Accordingly, the transmitting portion 11 can determine whether the correction is needed or not or whether the correction can be performed or not on the basis of the rank of the transistor Tr1.

Note that the examination is performed in such a manner that the signal CSt is input from the transmitting portion 11 to the control portion 12 (see FIG. 2A) and the signal Ctc is input from the controller 22 to the examination circuit 25. That is, when a predetermined command is input to the control portion 12, the characteristics of the elements included in the pixel 31 can be examined and the examination results can be output to the outside of the control portion 12. Note that the signal CSt transmitted from the transmitting portion 11 to the control portion 12 may be encrypted.

Through the above operation, the characteristics of the elements included in the pixel 31 can be examined.

[Display System]

Figure 5:
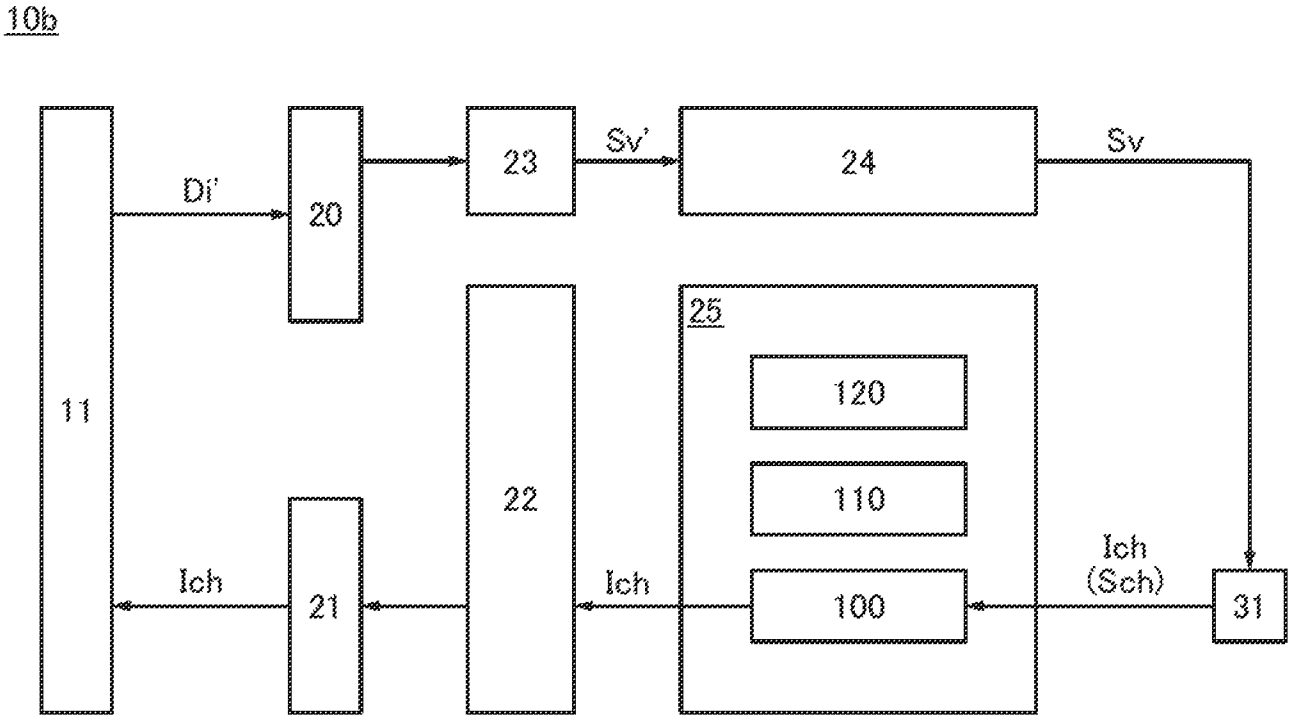
FIG. 5 illustrates an operation example of a system.

FIG. 5 illustrates an operation example of the display system 10*b*. When the correction of the image data is determined to be necessary by the examination, the display system 10*b* has a function of correcting the image data and displaying an image on the basis of the corrected image data.

First, the signal Sv is supplied from the driver circuit 24 to the pixel 31, and the current Ich flowing through the transistor Tr1 (see FIG. 1B) at this time is input to the converter circuit 100. Then, the current Ich converted into a digital signal is input to the controller 22. After that, the current Ich is output to the transmitting portion 11 via the interface 21.

The transmitting portion 11 corrects the data Di transmitted to the control portion 12 on the basis of the current Ich. Specifically, the image data is corrected so that the current Ich flowing through the transistor Tr1 is corrected to be ideal current that should flow when the signal Sv is supplied to the pixel 31. Then, corrected image data Di' is input to the image processing portion 23 via the interface 20. After that, the image processing portion 23 generates a signal Sv' on the basis of the data Di' and outputs the signal Sv' to the driver circuit 24.

Through the above operation, the image data can be corrected on the basis of the examination results of the element characteristics. Note that the transmitting portion 11 can determine the content of the correction independently. Thus, the external correction with a high degree of freedom can be performed.

<Configuration Example of Display Portion>

Figure 6:
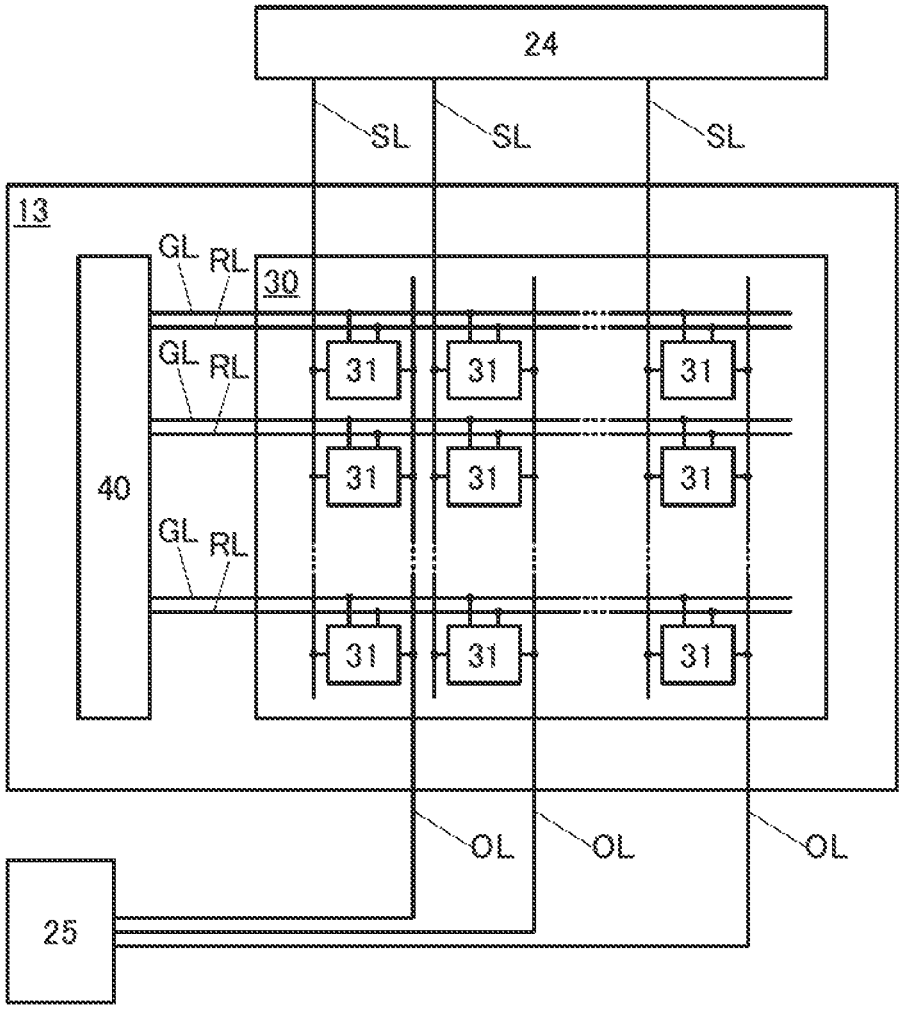
FIG. 6 illustrates a configuration example of a display portion.

Next, a specific configuration example of the display portion 13 is described. FIG. 6 illustrates a configuration example of the display portion 13. The display portion 13 includes the pixel portion 30 and a driver circuit 40.

The driver circuit 40 has a function of supplying a signal for selecting the pixels 31 (hereinafter, this signal is also referred to as a selection signal) to the pixel portion 30. Specifically, the driver circuit 40 has a function of supplying the selection signal to a wiring GL connected to the pixels 31 to which video signals are written and supplying the selection signal to a wiring RL connected to the pixels 31 from which the element characteristics are read out. The wiring GL and the wiring RL each have a function of transmitting the selection signal output from the driver circuit 40.

The driver circuit 24 has a function of supplying the video signal to each wiring SL. The video signal supplied to each wiring SL is written to the pixels 31 selected by the driver circuit 40.

The pixels 31 are connected to a wiring OL. The signal Sch including the information on the characteristics of the elements included in the pixels 31 is output to the wiring OL. The signal Sch output to the wiring OL is input to the examination circuit 25.

Figure 7A:
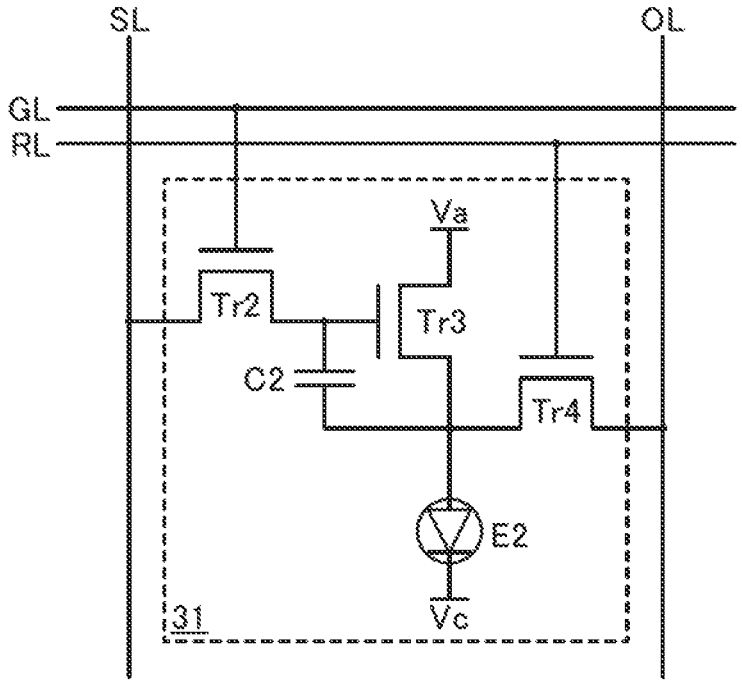
FIGS. 7A and 7B illustrate a configuration example and an operation example of a pixel.

Next, a configuration example of the pixel 31 connected to the wiring OL is described. FIG. 7A illustrates the configuration example of the pixel 31.

The pixel 31 includes a transistor Tr2, a transistor Tr3, a transistor Tr4, a capacitor C2, and a light-emitting element E2. A gate of the transistor Tr2 is connected to the wiring GL. One of a source and a drain of the transistor Tr2 is connected to a gate of the transistor Tr3 and one electrode of the capacitor C2. The other of the source and the drain of the transistor Tr2 is connected to the wiring SL. One of a source and a drain of the transistor Tr3 is connected to one electrode of the light-emitting element E2, the other electrode of the capacitor C2, and one of a source and a drain of the transistor Tr4. The other of the source and the drain of the transistor Tr3 is connected to a wiring to which a potential Va is supplied. A gate of the transistor Tr4 is connected to the wiring RL and the other of the source and the drain of the transistor Tr4 is connected to the wiring OL. The other electrode of the light-emitting element E2 is connected to a wiring to which a potential Vc (<Va) is supplied. Here, a fixed potential is supplied to the wiring OL.

Figure 7B:
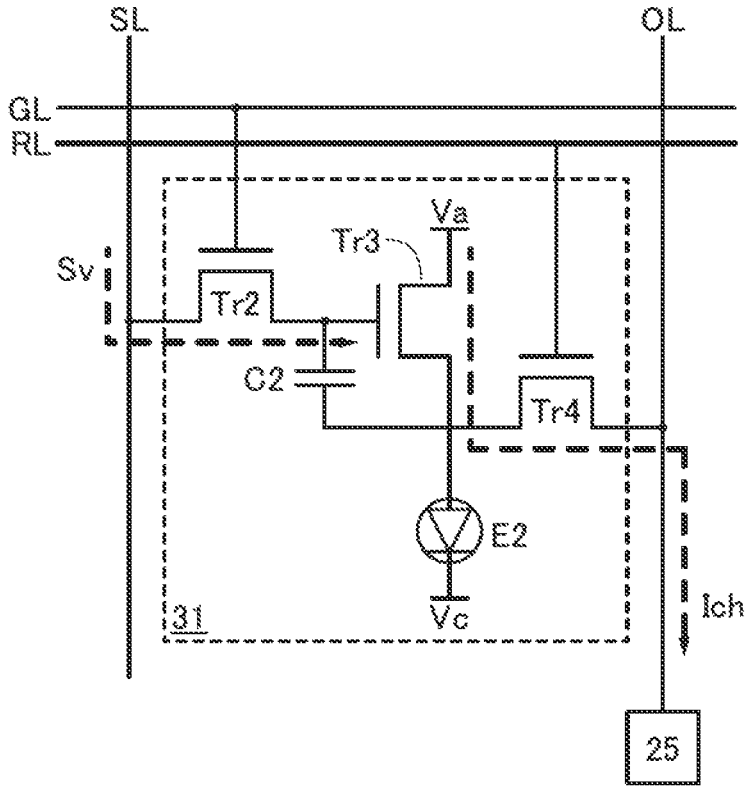

FIG. 7B illustrates an operation example of the pixel 31. The potentials of the wiring GL and the wiring RL are controlled to turn on the transistor Tr2 and the transistor Tr4, whereby the potential (the signal Sv) of the wiring SL is supplied to the gate of the transistor Tr3. In addition, the potential of the wiring OL is supplied to one of the source and the drain of the transistor Tr3. At this time, the potential of the wiring OL is close to the potential Vc and current does not flow through the light-emitting element E2. Then, the potentials of the wiring GL and the wiring RL are controlled to turn off the transistor Tr2 and the transistor Tr4. Accordingly, a gate potential of the transistor Tr3 is increased while a potential between the gate and the source of the transistor Tr3 is held.

Note that an OS transistor is preferably used as the transistor Tr2. A metal oxide has a larger energy gap and a lower minority carrier density than a semiconductor such as silicon; thus, the off-state current of an OS transistor is extremely low. Accordingly, when an OS transistor is used as the transistor Tr2, a video signal can be held in the pixel 31 for a long time as compared to the case where a transistor containing silicon in its channel formation region (such a transistor is also referred to as a Si transistor) is used. Consequently, the frequency of writing the video signal to the pixel 31 can be greatly reduced, whereby the power consumption can be reduced. The frequency of writing the video signal is, for example, less than once per second, preferably less than 0.1 times per second, further preferably less than 0.01 times per second.

In the case where the frequency of writing the video signal is reduced, power supply to the driver circuit 24 is preferably stopped in a period during which the driver circuit 24 does not generate the video signal. Accordingly, the power consumption of the control portion 12 can be reduced. The power supply to the driver circuit 24 is controlled by the controller 22.

The transistor Tr3 has a function of supplying current corresponding to a potential between the gate and the source, i.e., the video signal to the light-emitting element E2. The light-emitting element E2 emits light with luminance corresponding to the current flowing through the light-emitting element E2. Accordingly, the pixel 31 can display a gray level corresponding to the video signal. The transistor Tr3 and the light-emitting element E2 correspond to the transistor Tr1 and the light-emitting element E1 in FIG. 1B, respectively.

Note that the amount of current supplied to the light-emitting element E2 is affected by the characteristics of the transistor Tr3. Thus, when the pixel 31 displays a gray level, the characteristics of the transistor Tr3 are preferably examined by outputting a signal including the information on the characteristics of the transistor Tr3. Here, the case where the current Ich flowing through the transistor Tr3 is output as the signal Sch (see FIGS. 1A and 1B) to the examination circuit 25 is described as an example.

When the current Ich is output, the potential of the wiring RL is controlled to turn on the transistor Tr4 as illustrated in FIG. 7B. Accordingly, the current flowing through the transistor Tr3 is output to the wiring OL and then output as the current Ich to the examination circuit 25. After that, the examination circuit 25 calculates the variations in the characteristics of the transistor Tr3 (e.g., the threshold voltage and the field-effect mobility) on the basis of the current Ich.

Here, the current flowing through the transistor Tr3 is used as the signal Sch; however, the other signals may be used. For example, the current flowing through the light-emitting element E2 can also be used as the signal Sch. In this case, the characteristics of the light-emitting element E2, such as the threshold voltage, can be examined.

As described above, the element characteristics can be examined by outputting the signal Sch to the wiring OL.

Note that the transistor Tr2 is not necessarily the OS transistor. For example, a transistor whose channel formation region is formed in part of a substrate containing a single-crystal semiconductor other than a metal oxide may be used. Examples of such a substrate include a single-crystal silicon substrate and a single-crystal germanium substrate. In addition, a transistor whose channel formation region is formed in a film containing a material other than a metal oxide can be used as the transistor Tr2. Examples of a material other than a metal oxide include silicon, germanium, silicon germanium, silicon carbide, gallium arsenide, aluminum gallium arsenide, indium phosphide, gallium nitride, and an organic semiconductor. Each of the above materials may be a single-crystal semiconductor or a non-single-crystal semiconductor such as an amorphous semiconductor, a microcrystalline semiconductor, or a polycrystalline semiconductor.

A material that can be used for the transistors Tr3 and Tr4 is similar to that of the transistor Tr2.

<Structure Example of Display Module>

Figure 8:
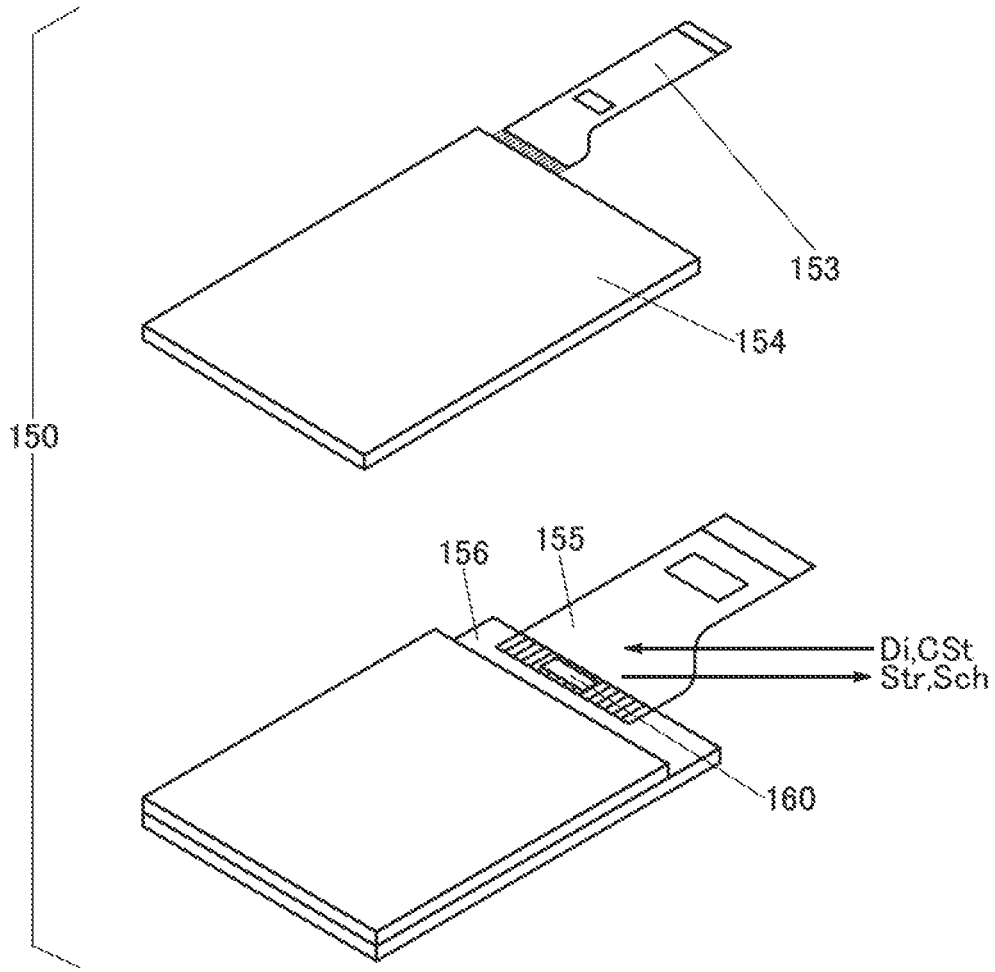
FIG. 8 illustrates a structure example of a display module.

Next, a structure example of a display module including the control portion 12 and the display portion 13 illustrated in FIG. 1A is described. FIG. 8 illustrates the structure example of the display module.

A display module 150 includes a touch panel 154 connected to an FPC 153 and a display device 156 connected to an FPC 155.

The touch panel 154 can be a resistive touch panel or a capacitive touch panel and may be formed to overlap with the display device 156. Instead of providing the touch panel 154, the display device 156 can have a touch panel function. In addition, the display device 156 has a function of displaying an image using a light-emitting element.

The display module 150 may be additionally provided with a member such as a polarizing plate, a retardation plate, or a prism sheet.

The control portion 12 and the display portion 13 illustrated in FIG. 1A can be provided in the display device 156. That is, the display module 150 includes a display portion including a light-emitting element and a control portion including an examination circuit. Here, an integrated circuit 160 functioning as the control portion 12 in FIG. 1A is provided in the display device 156. Note that the integrated circuit 160 can be mounted on the display device 156 by a chip on glass (COG) method, a chip on film (COF) method, or the like.

A user of the display module 150 can examine the characteristics of the elements included in the display device 156 by inputting the signal CSt to the integrated circuit 160 and can receive the examination results as the signal Str. In addition, the user of the display module 150 can receive the characteristics of the elements included in the display device 156 as the signal Sch by inputting the signal CSt to the integrated circuit 160, and the data Di corrected on the basis of the signal Sch can be output to the integrated circuit 160. Thus, after purchasing the display module 150, the user can easily examine the element characteristics and can determine the content of the correction on the basis of the user's evaluation standard.

As described above, the display module 150 including the control portion 12 can achieve a versatile display module.

<Structure Example of Electronic Device>

Figure 9A:
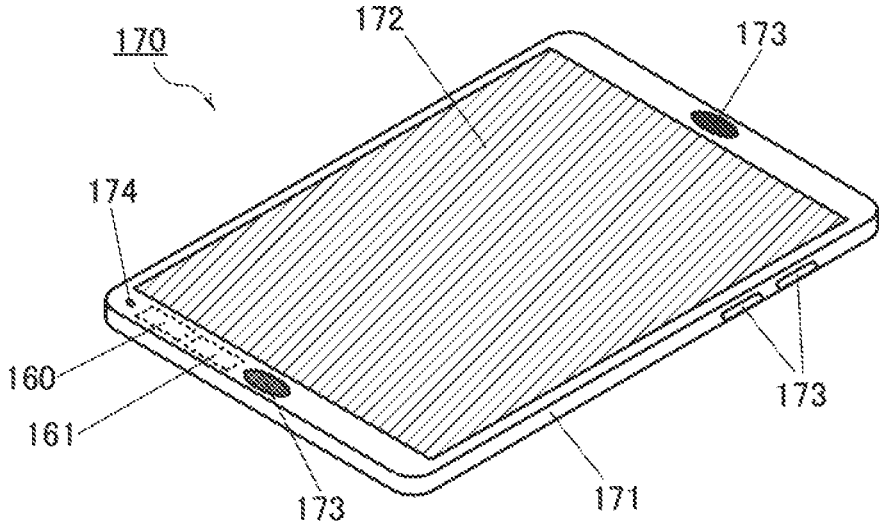
FIGS. 9A and 9B each illustrate a structure example of an electronic device.
Figure 9B:
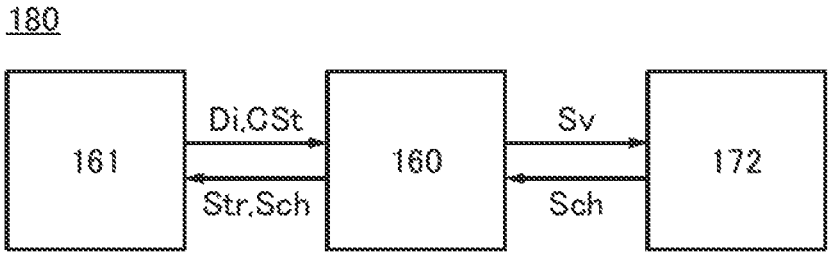

Next, a structure example of an electronic device including the display module in FIG. 8 is described. FIGS. 9A and 9B illustrate a structure example of a tablet information terminal as an example of an electronic device.

FIG. 9A illustrates a structure example of a tablet information terminal. An information terminal 170 includes a housing 171, a display portion 172, operation keys 173, and a speaker 174. Note that a display device having a position-input function can be used as the display portion 172. The position-input function can be added by providing a touch panel in a display device or by providing a pixel portion including a photoelectric conversion element in a display device, for example. The operation keys 173 can be used as any one of a power switch for starting the information terminal 170, a button for operating an application of the information terminal 170, a volume control button, and a switch for turning on or off the display portion 172.

Although the number of operation keys 173 illustrated in FIG. 9A is four, the number and position of operation keys included in the information terminal 170 are not limited to this example. The information terminal 170 may also include a microphone. Thus, the information terminal 170 can have a telephone function like a cellular phone, for example. The information terminal 170 may also include a camera. The information terminal 170 may also include a light-emitting device for use as a flashlight or a lighting device.

The information terminal 170 may also include a sensor (which measures force, displacement, position, speed, acceleration, angular velocity, rotational frequency, distance, light, liquid, magnetism, temperature, a chemical substance, a sound, time, hardness, electric field, current, voltage, electric power, radiation, flow rate, humidity, gradient, oscillation, smell, infrared rays, or the like) inside the housing 171. In particular, when a measuring device including a sensor such as a gyroscope sensor or an acceleration sensor for measuring inclination is provided, display on the screen of the display portion 172 can be automatically changed in accordance with the orientation of the information terminal 170 by determining the orientation of the information terminal 170 (the orientation of the information terminal with respect to the vertical direction).

The information terminal 170 can be provided with the display module 150 illustrated in FIG. 8. In this case, the display device 156 provided with the integrated circuit 160 is used as the display portion 172. In addition, the information terminal 170 includes a processor 161 transmitting and receiving a signal to and from the integrated circuit 160. In this manner, the information terminal 170 is provided with a system of one embodiment of the present invention.

FIG. 9B illustrates a configuration example of a system 180 provided for the information terminal 170. The system 180 includes the processor 161, the integrated circuit 160, and the display portion 172. The processor 161, the integrated circuit 160, and the display portion 172 correspond to the transmitting portion 11, the control portion 12, and the display portion 13 in FIG. 1A, respectively.

The processor 161 transmits the data Di to the integrated circuit 160, and the integrated circuit 160 generates the signal Sv using the data Di and transmits the signal Sv to the display portion 172. Then, the display portion 172 inputs the signal Sch including the information on the element characteristics to the integrated circuit 160, and the element characteristics are examined in the integrated circuit 160.

After that, the integrated circuit 160 outputs the signal Str or the signal Sch to the processor 161. The processor 161 evaluates the display portion 172 using the signal Str or corrects the data Di using the signal Sch. The corrected data Di is transmitted to the integrated circuit 160, and the signal Sv generated using the data Di is output from the integrated circuit 160 to the display portion 172.

As described above, an electronic device including the system 180 can correct image data using the processor 161.

A manufacturer of an electronic device can assemble an electronic device which includes the display module 150 in FIG. 8 purchased by the manufacturer and the processor 161 manufactured by the manufacturer. Note that the processor 161 can execute correction set by the manufacturer of the electronic device. Accordingly, an electronic device having a high added value can be provided.

As described above, when a semiconductor device functioning as a control portion is provided with an examination circuit, one embodiment of the present invention can easily perform evaluation of element characteristics and correction of image data. In addition, when a control portion of one embodiment of the present invention is included in a display module, a versatile display module can be provided. In addition, when an electronic device is provided with a system of one embodiment of the present invention, an electronic device having a high added value can be provided.

This embodiment can be combined with any of the other embodiments as appropriate.

Embodiment 2

In this embodiment, modification examples of the pixel described in the above embodiment are described.

Modification examples of the pixel 31 illustrated in FIGS. 7A and 7B are illustrated in FIGS. 10A and 10B and FIGS. 11A and 11B.

Figure 10A:
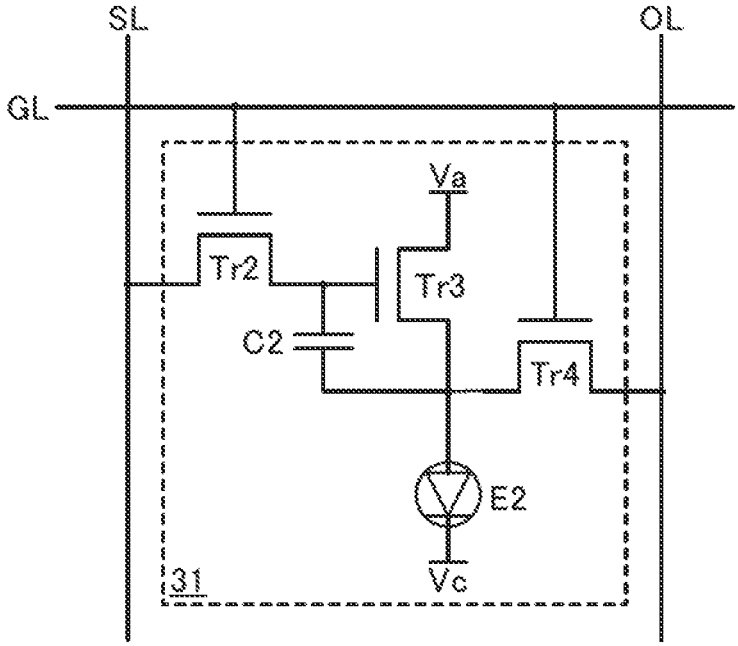
FIGS. 10A and 10B each illustrate a configuration example of a pixel.

An element included in the pixel 31 can share a predetermined wiring with another element. The pixel 31 illustrated in FIG. 10A is different from that illustrated in FIGS. 7A and 7B in that the gate of the transistor Tr4 is connected to the wiring GL. That is, the gate of the transistor Tr2 and the gate of the transistor Tr4 are connected to the same wiring. In this case, the on/off states of the transistor Tr2 and the transistor Tr4 are controlled at the same time by the potential of the wiring GL.

Figure 10B:
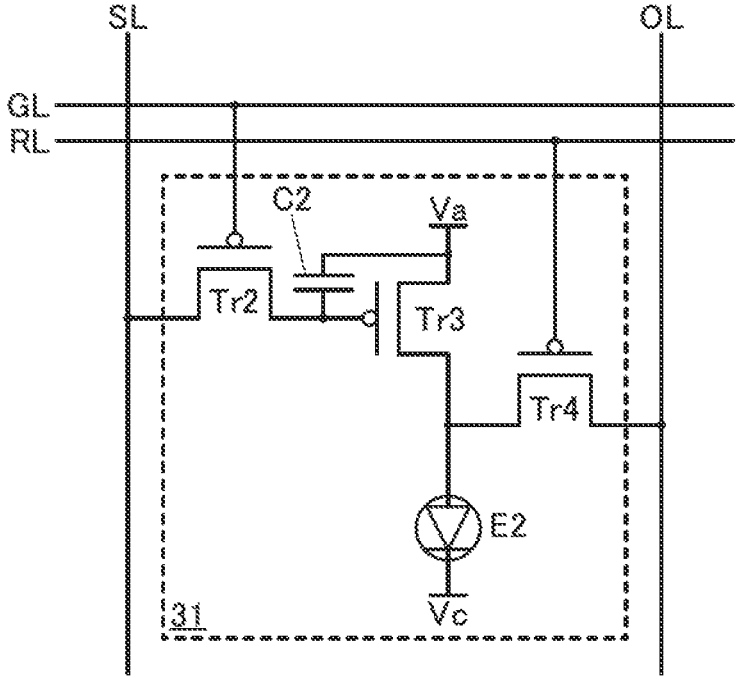

The polarity of the transistor, the orientation of the light-emitting element, the potential of the wiring, and the like in the pixel 31 can be changed as appropriate. The pixel 31 illustrated in FIG. 10B is different from that illustrated in FIGS. 7A and 7B in the polarity of the transistors Tr2, Tr3, and Tr4, that is, the transistors Tr2, Tr3, and Tr4 are p-channel transistors. In addition, one electrode of the capacitor C2 is connected to the gate of the transistor Tr3 and the other electrode is connected to the wiring to which the potential Va is supplied.

An element other than the elements illustrated in FIGS. 7A and 7B can be provided in the pixel 31 as appropriate. For example, as illustrated in FIG. 1A, a switch SW2 can be provided between the transistor Tr3 and the light-emitting element E2. The switch SW2 is off in a period during which the element characteristics are read out, whereby the amount of current flowing through the transistor Tr3 can be accurately transmitted to the wiring OL regardless of the potential of the wiring OL.

Figure 11A:
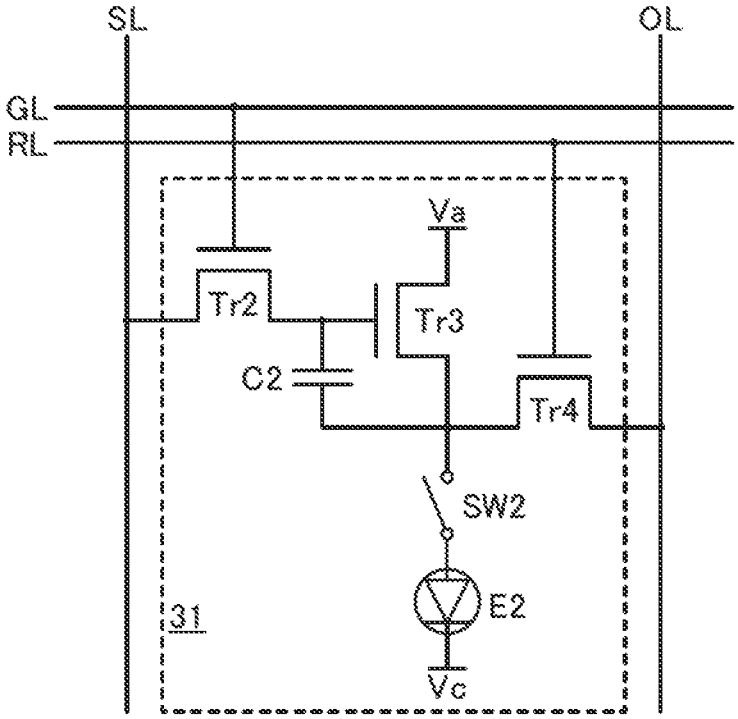
FIGS. 11A and 11B each illustrate a configuration example of a pixel.
Figure 11B:
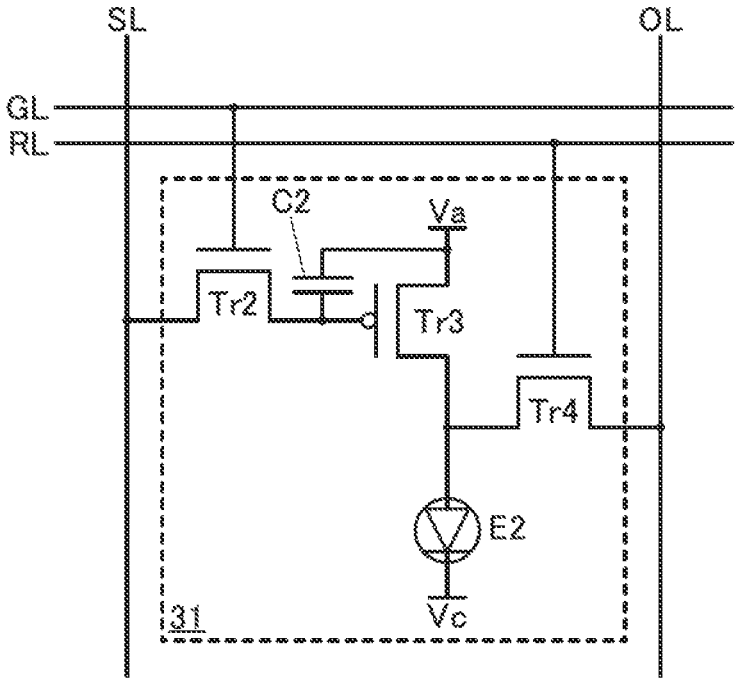

Transistors having different polarities may be provided in the pixel 31. For example, as illustrated in FIG. 11B, the transistors Tr2 and Tr4 can be n-channel transistors and the transistor Tr3 can be a p-channel transistor. Note that a connection relationship between the capacitor C2 and other components in FIG. 11B is the same as that in FIG. 10B.

This embodiment can be combined with any of the other embodiments as appropriate.

Embodiment 3

In this embodiment, modification examples of the display portion described in the above embodiment are described. In particular, a configuration in which the display portion includes a plurality of pixel groups is described.

<Configuration Example of Display Portion>

Figure 12:
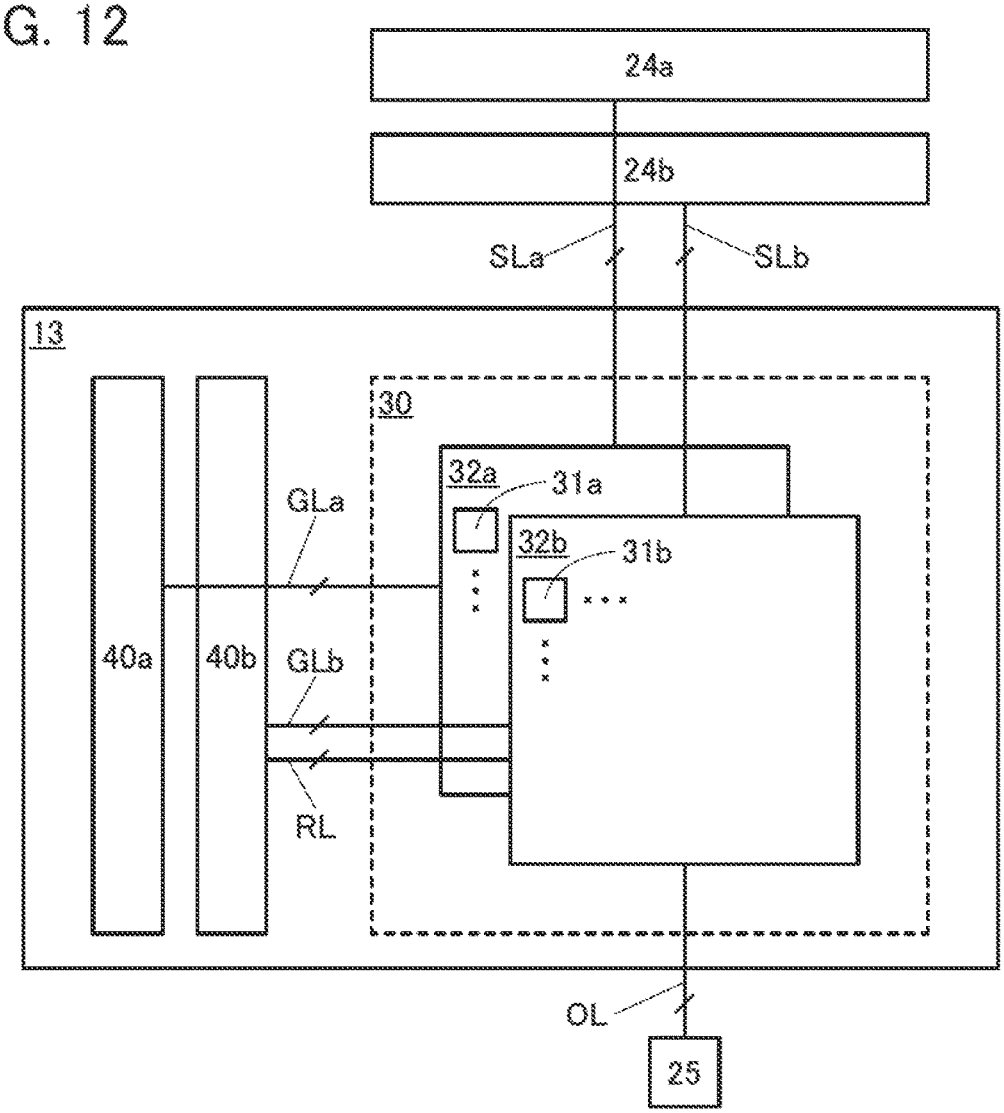
FIG. 12 illustrates a configuration example of a display portion.

FIG. 12 illustrates a configuration example of the display portion 13. The display portion 13 illustrated in FIG. 12 includes a plurality of driver circuits 40. The pixel portion 30 includes a plurality of pixel groups 32. A configuration is described below as an example in which the display portion 13 includes two pixel groups 32 (pixel groups 32*a* and 32*b*) and two driver circuits 40 (driver circuits 40*a* and 40*b*). Note that the number of these circuits may be three or more.

The pixel group 32*a* includes a plurality of pixels 31*a* and the pixel group 32*b* includes a plurality of pixels 31*b*. The pixel group 32*a* is connected to the driver circuit 24*a* and the pixel group 32*b* is connected to the driver circuit 24*b*. The pixels 31*a* and 31*b* each include a display element and have a function of displaying a predetermined gray level. The kind and characteristics of the display elements included in the pixels 31*a* may be the same as or different from those of the display elements included in the pixels 31*b*. The circuit configuration of the pixels 31*a* may be the same as or different from that of the pixels 31*b*. The plurality of pixels 31*a* or the plurality of pixels 31*b* each display a predetermined gray level, whereby the pixel portion 30 displays a predetermined image.

Examples of the display element include a liquid crystal element and a light-emitting element. As the liquid crystal element, a transmissive liquid crystal element, a reflective liquid crystal element, a transflective liquid crystal element, or the like can be used. As the display element, a micro electro mechanical systems (MEMS) shutter element, an optical interference type MEMS element, a display element using a microcapsule method, an electrophoretic method, an electrowetting method, an Electronic Liquid Powder (registered trademark) method, or the like can be used.

Examples of the light-emitting element include a self-luminous light-emitting element such as an OLED, an LED, a QLED, and a semiconductor laser.

An image may be displayed using either one or both of the pixel groups 32*a* and 32*b*. In the case where both of the pixel groups 32*a* and 32*b* are used, the pixel groups 32*a* and 32*b* may display one image, or the pixel groups 32*a* and 32*b* may display different images from each other.

In the case where either one of the pixel groups 32*a* and 32*b* is used for displaying an image, the pixel group 32 which displays an image can be selected automatically or manually. Note that by providing different display elements in the pixels 31*a* and 31*b*, the characteristics, the quality, and the like of images displayed by the pixel group 32*a* and the pixel group 32*b* can be made different from each other. In this case, the pixel group 32 which displays an image can be selected in accordance with the surroundings, the content of a displayed image, and the like. A configuration is described below as an example in which a reflective liquid crystal element is provided in the pixel 31*a* and a light-emitting element is provided in the pixel 31*b*.

A driver circuit 40*a* has a function of supplying a selection signal to a wiring GLa connected to the pixels 31*a*, and the wiring GLa has a function of transmitting the selection signal output from the driver circuit 40*a*. A driver circuit 40*b* has a function of supplying a selection signal to a wiring GLb and the wiring RL that are connected to the pixels 31*b*, and the wiring GLb and the wiring RL each have a function of transmitting the selection signal output from the driver circuit 40*b*.

The driver circuit 24*a* has a function of supplying a video signal to a wiring SLa connected to the pixels 31*a*, and the driver circuit 24*b* has a function of supplying a video signal to a wiring SLb connected to the pixels 31*b*. The video signals supplied to the wirings SLa and SLb are written to the pixels 31*a* and 31*b* selected by the driver circuits 40*a* and 40*b*.

Note that the pixel 31*b*, the driver circuit 40*b*, and the driver circuit 24*b* correspond to the pixel 31, the driver circuit 40, and the driver circuit 24 in FIG. 6, respectively.

Figure 13:
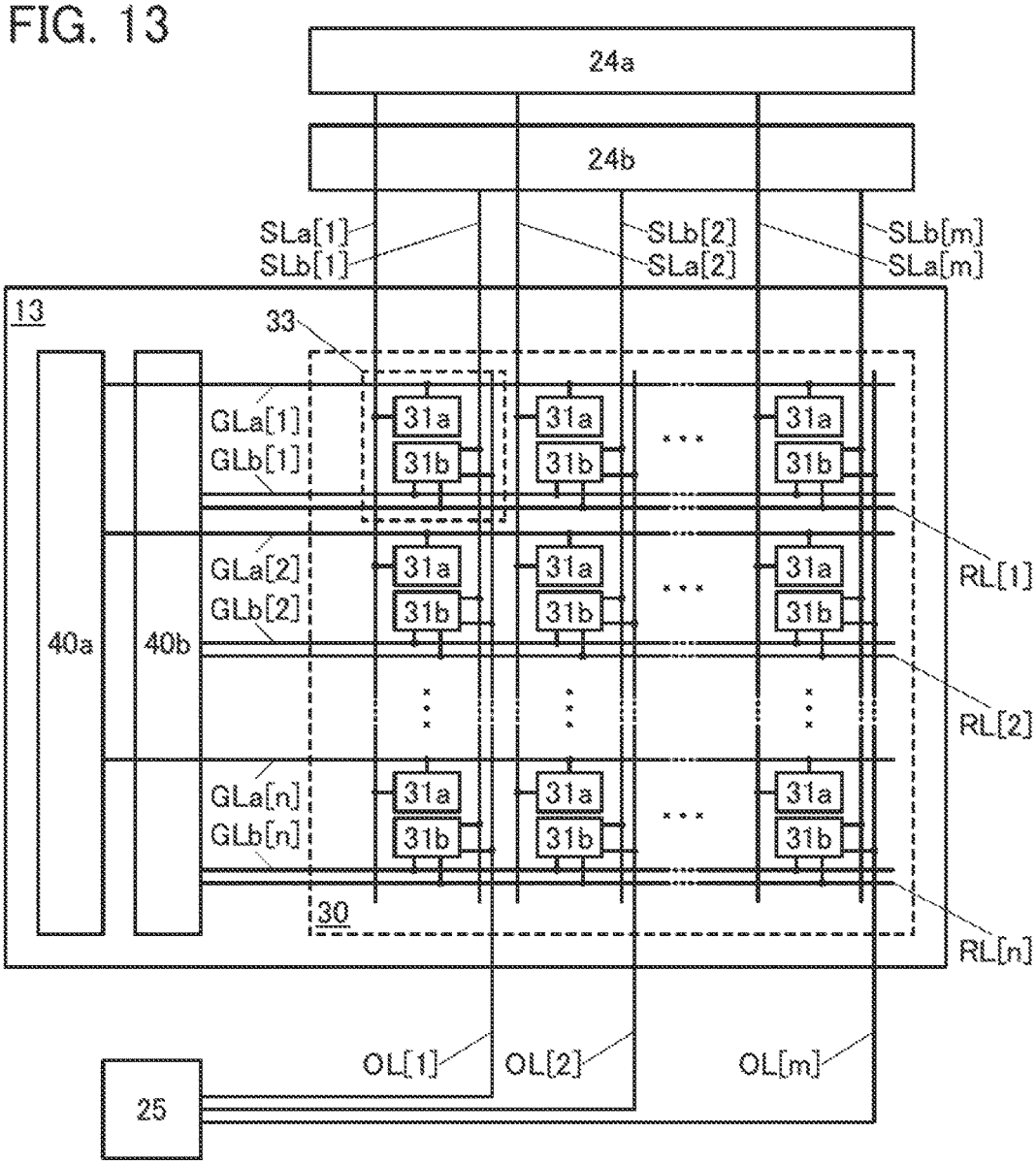
FIG. 13 illustrates a configuration example of a display portion.

FIG. 13 illustrates a more specific configuration example of the display portion 13. The pixel portion 30 includes the pixels 31*a* and the pixels 31*b* arranged in m columns and n rows (m and n are each an integer of 2 or more). The pixel 31*a* in the i-th column and the j-th row (i is an integer greater than or equal to 1 and less than or equal to m, and j is an integer greater than or equal to 1 and less than or equal to n) is connected to a wiring SLa[i] and a wiring GLa[j]. The pixel 31*b* in the i-th column and the j-th row is connected to a wiring SLb[i], a wiring GLb[j], a wiring OL[i], and a wiring RL[j]. Wirings GLa[1] to GLa[n] are connected to the driver circuit 40*a*, and wirings GLb[1] to GLb[n] and wirings RL[1] to RL[n] are connected to the driver circuit 40*b*. Wirings SLa[1] to SLa[m] are connected to the driver circuit 24*a* and wirings SLb[1] to SLb[m] are connected to the driver circuit 24*b*. Here, the pixels 31*a* and 31*b* are alternately provided in the column direction (the direction in which the wirings SLa and SLb extend, i.e., the vertical direction), and a pixel unit 33 includes the pixels 31*a* and 31*b*. As described above, the pixels 31*a* and 31*b* can be provided in the same region of the pixel portion 30.

Figure 14:
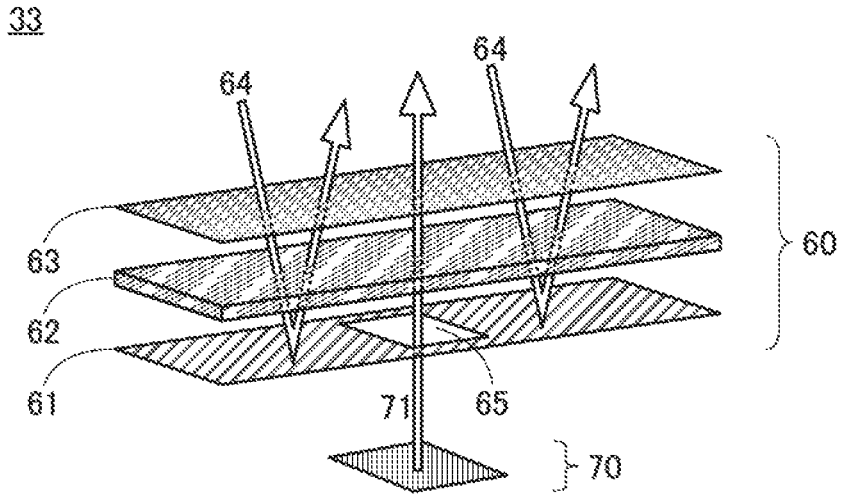
FIG. 14 illustrates a configuration example of a pixel unit.

The pixel unit 33 can display a gray level using one or both of the reflective liquid crystal element and the light-emitting element. FIG. 14 is a schematic view of a configuration of the pixel unit 33 which performs display using a reflective liquid crystal element 60 and a light-emitting element 70. The liquid crystal element 60 includes a reflective electrode 61, a liquid crystal layer 62, and a transparent electrode 63.

A gray level of the liquid crystal element 60 is controlled by controlling transmittance of the liquid crystal layer 62 with respect to light 64 reflected by the reflective electrode 61. Note that the transmittance is controlled with alignment of liquid crystals. The light 64 reflected by the reflective electrode 61 passes through the liquid crystal layer 62 and the transparent electrode 63 and is extracted to the outside. The reflective electrode 61 includes an opening 65, and the light-emitting element 70 is provided to overlap with the opening 65. A gray level of the light-emitting element 70 is controlled by controlling the intensity of light 71 emitted from the light-emitting element 70. Note that the intensity of the light 71 is controlled by controlling current flowing through the light-emitting element 70. The light 71 emitted from the light-emitting element 70 passes through the opening 65, the liquid crystal layer 62, and the transparent electrode 63 and is extracted to the outside. The light 64 and the light 71 are emitted toward a display surface of the display portion 13.

With such a structure, the pixel portion 30 can display an image using the reflective liquid crystal element 60 and the light-emitting element 70.

The display portion 13 has a first mode in which an image is displayed using a reflective liquid crystal element, a second mode in which an image is displayed using a light-emitting element, and a third mode in which an image is displayed using a reflective liquid crystal element and a light-emitting element. The display portion 13 can be switched between these modes automatically or manually.

In the first mode, an image is displayed using the reflective liquid crystal element and external light. Because a light source is unnecessary in the first mode, power consumed in this mode is extremely low. When sufficient external light enters a display device (e.g., in a bright environment), for example, an image can be displayed by using light reflected by the reflective liquid crystal element. The first mode is effective in the case where external light is white light or light near white light and is sufficiently strong, for example. The first mode is suitable for displaying text. Furthermore, the first mode enables eye-friendly display owing to the use of reflected external light, which leads to an effect of easing eyestrain.

In the second mode, an image is displayed using light emitted from the light-emitting element. Thus, an extremely vivid image (with high contrast and excellent color reproducibility) can be displayed regardless of the illuminance and the chromaticity of external light. The second mode is effective in the case of extremely low illuminance, such as in a night environment or in a dark room, for example. When a bright image is displayed in a dark environment, a user may feel that the image is too bright. To prevent this, an image with reduced luminance is preferably displayed in the second mode. In that case, glare can be reduced, and power consumption can also be reduced. The second mode is suitable for displaying a vivid (still and moving) image or the like.

In the third mode, an image is displayed using both light reflected by the reflective liquid crystal element and light emitted from the light-emitting element. An image displayed in the third mode can be more vivid than an image displayed in the first mode while power consumption can be lower than that in the second mode. The third mode is effective in the case where the illuminance is relatively low or in the case where the chromaticity of external light is not white, for example, in an environment under indoor illumination or in the morning or evening. With the use of the combination of reflected light and emitted light, an image that makes a viewer feel like looking at a painting can be displayed.

With such a structure, an all-weather display device or a highly convenient display device with high visibility regardless of the ambient brightness can be fabricated.

Each of the pixels 31*a* and the pixels 31*b* can include one or more sub-pixels. For example, each pixel can include one sub-pixel (e.g., a white (W) sub-pixel), three sub-pixels (e.g., red (R), green (G), and blue (B) sub-pixels, or yellow (Y), cyan (C), and magenta (M) sub-pixels), or four sub-pixels (e.g., red (R), green (G), blue (B), and white (W) sub-pixels, or red (R), green (G), blue (B), and yellow (Y) sub-pixels).

The display portion 13 can display a full-color image using either the pixels 31*a* or the pixels 31*b*. Alternatively, the display portion 13 can display a black-and-white image or a grayscale image using the pixels 31*a* and can display a fill-color image using the pixels 31*b*. The pixels 31*a* that can be used for displaying a black-and-white image or a grayscale image are suitable for displaying information that need not be displayed in color such as text information.

In the third mode, the color tone can be corrected by using light emission from the light-emitting element at the time of display of an image by the reflective liquid crystal element. For example, in the case where an image is displayed in a reddish environment at evening, a blue (B) component is not sufficient only with the display by the reflective liquid crystal element in some cases; thus, the color tone can be corrected by making the light-emitting element emit light.

In addition, in the third mode, a still image that is a background, text, and the like are displayed by the reflective liquid crystal element, whereas a moving image and the like are displayed by the light-emitting element, for example. Accordingly, a high-quality image display and a reduction in the power consumption both can be achieved. Such a structure is suitable for the case where a display device is used as a teaching material such as a textbook, a notebook, or the like.

The display portion 13 can be switched between the first mode or the second mode and the third mode depending on the definition of a displayed image. For example, an image or a picture with high resolution can be displayed in the third mode, whereas a background, text, and the like can be displayed in the first mode or the second mode. Accordingly, the definition can be changed with a displayed image; as a result, a versatile display device can be achieved.

Although an example in which the reflective liquid crystal element is provided in the pixel 31*a* and the light-emitting element is provided in the pixel 31*b* is described with reference to FIG. 12 and FIG. 13, there is no particular limitation on the display elements provided in the pixels 31*a* and 31*b*, and the kind of display element can be freely selected. For example, different kinds of light-emitting elements can be provided in the pixels 31*a* and 31*b*. In this case, examination of element characteristics and correction of image data can be performed on the pixel groups 32*a* and 32*b*.

<Configuration Example of Pixel Unit>

Next, configuration examples of the pixel unit 33 including a reflective liquid crystal element and a light-emitting element are described with reference to FIGS. 15A to 15D, FIG. 16, and FIGS. 17A and 17B.

FIGS. 15A to 15D illustrate configuration examples of an electrode 611 included in the pixel unit 33. The electrode 611 serves as a reflective electrode of the liquid crystal element. The opening 601 is provided in the electrode 611 in FIGS. 15A and 15B.

Figure 15A:
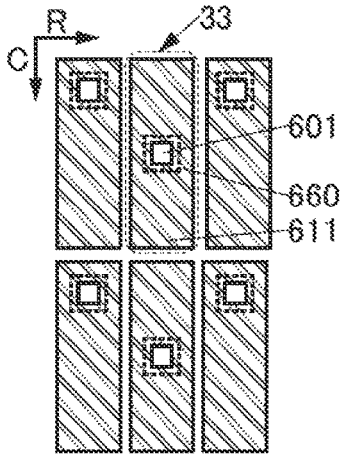
FIGS. 15A to 15D each illustrate a configuration example of a pixel unit.
Figure 15B:
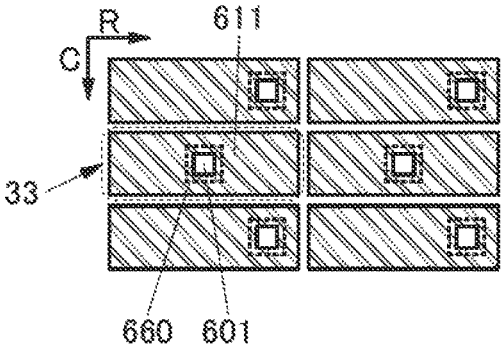

In FIGS. 15A and 15B, a light-emitting element 660 positioned in a region overlapping with the electrode 611 is indicated by a broken line. The light-emitting element 660 overlaps with the opening 601 included in the electrode 611. Thus, light from the light-emitting element 660 is emitted to the display surface side through the opening 601.

In FIG. 15A, the pixel units 33 adjacent in the direction indicated by an arrow R correspond to different emission colors. As illustrated in FIG. 15A, the openings 601 are preferably provided in different positions in the electrodes 611 so as not to be aligned in the two pixel units 33 adjacent to each other in the direction indicated by the arrow R. This allows the two light-emitting elements 660 to be apart from each other, thereby preventing light emitted from the light-emitting element 660 from entering a coloring layer in the adjacent pixel unit 33 (such a phenomenon is also referred to as crosstalk). Furthermore, since the two adjacent light-emitting elements 660 can be arranged apart from each other, a high-resolution display device can be achieved even when EL layers of the light-emitting elements 660 are separately formed with a shadow mask or the like.

In FIG. 15B, the pixel units 33 adjacent in a direction indicated by an arrow C correspond to different emission colors. Also in FIG. 15B, the openings 601 are preferably provided in different positions in the electrodes 611 so as not to be aligned in the two pixel units 33 adjacent to each other in the direction indicated by the arrow C.

The smaller the ratio of the total area of the opening 601 to the total area except for the opening is, the brighter an image displayed using the liquid crystal element can be. Furthermore, the larger the ratio of the total area of the opening 601 to the total area except for the opening is, the brighter an image displayed using the light-emitting element 660 can be.

The opening 601 may have a polygonal shape, a quadrangular shape, an elliptical shape, a circular shape, a cross-like shape, a stripe shape, a slit-like shape, or a checkered pattern, for example. The opening 601 may be provided close to the adjacent pixel unit 33. Preferably, the opening 601 is provided close to another pixel unit 33 emitting light of the same color, in which case crosstalk can be suppressed.

Figure 15C:
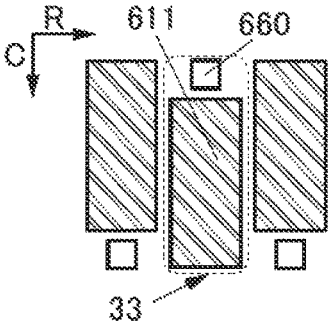
Figure 15D:
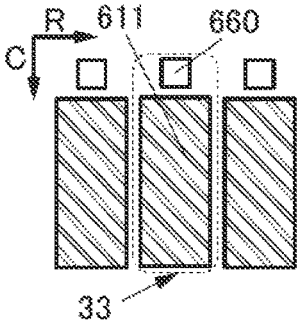

As illustrated in FIGS. 15C and 15D, a light-emitting region of the light-emitting element 660 may be positioned in a region where the electrode 611 is not provided, in which case light emitted from the light-emitting element 660 is emitted to the display surface side.

In FIG. 15C, the light-emitting elements 660 are not aligned in the two pixel units 33 adjacent in the direction indicated by the arrow R. In FIG. 15D, the light-emitting elements 660 are aligned in the two pixel units 33 adjacent to each other in the direction indicated by the arrow R.

The structure illustrated in FIG. 15C can, as mentioned above, prevent crosstalk and increase the resolution because the light-emitting elements 660 included in the two adjacent pixel units 33 can be apart from each other. The structure illustrated in FIG. 15D can prevent light emitted from the light-emitting element 660 from being blocked by the electrode 611 because the electrode 611 is not positioned along a side of the light-emitting element 660 which is parallel to the direction indicated by the arrow C. Thus, high viewing angle characteristics can be achieved.

Figure 16:
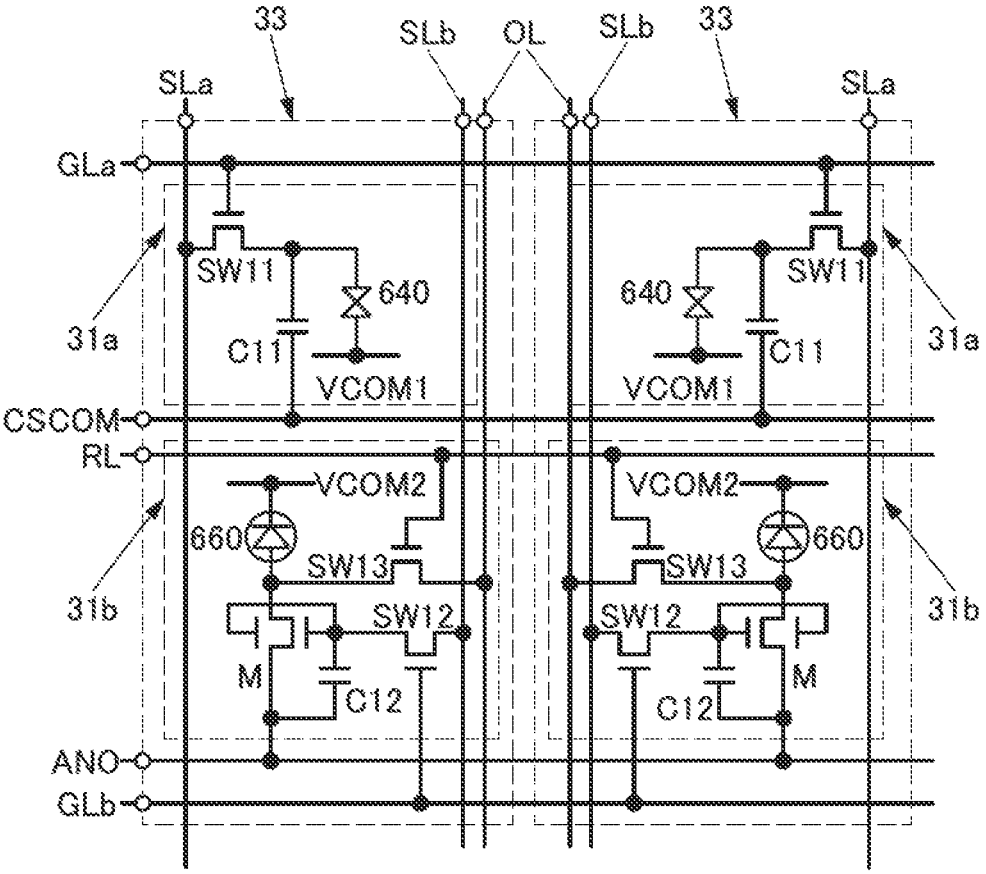
FIG. 16 illustrates a configuration example of a pixel unit.

Next, a circuit configuration of the pixel unit 33 is described. FIG. 16 is an example of a circuit diagram of the pixel units 33. FIG. 16 illustrates two adjacent pixel units 33.

The pixel unit 33 includes the pixel 31*a* including a switch SW11, a capacitor C11, and a liquid crystal element 640 and the pixel 31*b* including a switch SW12, a switch SW13, a transistor M, a capacitor C12, and the light-emitting element 660. The wiring GLa, the wiring GLb, a wiring ANO, a wiring CSCOM, the wiring SLa, the wiring SLb, the wiring RL, and the wiring OL are connected to the pixel unit 33. FIG. 16 illustrates a wiring VCOM1 connected to the liquid crystal element 640 and a wiring VCOM2 connected to the light-emitting element 660.

FIG. 16 illustrates an example in which a transistor is used as each of the switches SW11, SW12, and SW13. Note that the circuit configuration of the pixel 31*b* in FIG. 16 corresponds to that in FIG. 7A. The potential Va is supplied to the wiring ANO and the potential Vc is supplied to the wiring VCOM2.

A gate of the switch SW11 is connected to the wiring GLa. One of a source and a drain of the switch SW11 is connected to the wiring SLa, and the other of the source and the drain is connected to one electrode of the capacitor C11 and one electrode of the liquid crystal element 640. The other electrode of the capacitor C11 is connected to the wiring CSCOM. The other electrode of the liquid crystal element 640 is connected to the wiring VCOM1.

A gate of the switch SW12 is connected to the wiring GLb. One of a source and a drain of the switch SW12 is connected to the wiring SLb, and the other of the source and the drain is connected to one electrode of the capacitor C12 and a gate of the transistor M. The other electrode of the capacitor C12 is connected to one of a source and a drain of the transistor M and the wiring ANO. The other of the source and the drain of the transistor M is connected to one electrode of the light-emitting element 660. The other electrode of the light-emitting element 660 is connected to the wiring VCOM2.

A gate of the switch SW13 is connected to the wiring RL. One of a source and a drain of the switch SW13 is connected to the wiring OL, and the other of the source and the drain is connected to the other of the source and the drain of the transistor M.

FIG. 16 illustrates an example in which the transistor M includes two gates between which a semiconductor is provided and which are connected to each other. This structure can increase the amount of current flowing through the transistor M.

A predetermined potential can be supplied to each of the wirings VCOM1 and CSCOM.

The wiring VCOM2 and the wiring ANO can be supplied with potentials having a difference large enough to make the light-emitting element 660 emit light.

In the pixel unit 33 of FIG. 16, for example, an image can be displayed in a reflective mode by driving the pixel unit with the signals supplied to the wiring GLa and the wiring SLa and utilizing the optical modulation of the liquid crystal element 640. In the case where an image is displayed in a transmissive mode, the pixel unit is driven with the signals supplied to the wiring GLb and the wiring SLb and the light-emitting element 660 emits light. In the case where both modes are performed at the same time, the pixel unit can be driven with the signals supplied to the wirings GLa, GLb, SLa, and SLb.

As the switches SW11 and SW12, OS transistors are preferably used. With the use of the OS transistors, video signals can be held in the pixels 31*a* and 31*b* for an extremely long time; thus, gray levels displayed by the pixels 31*a* and 31*b* can be maintained for a long time. Accordingly, the frequency of writing a video signal can be reduced. The frequency of writing a video signal is, for example, less than once per second, preferably less than 0.1 times per second, further preferably less than 0.01 times per second.

In the case where the frequency of writing a video signal is reduced, the power supply to the driver circuits 24*a* and 24*b* (see FIG. 12) is preferably stopped in a period during which the driver circuits 24*a* and 24*b* do not generate video signals. Thus, the power consumption can be reduced.

Figure 17A:
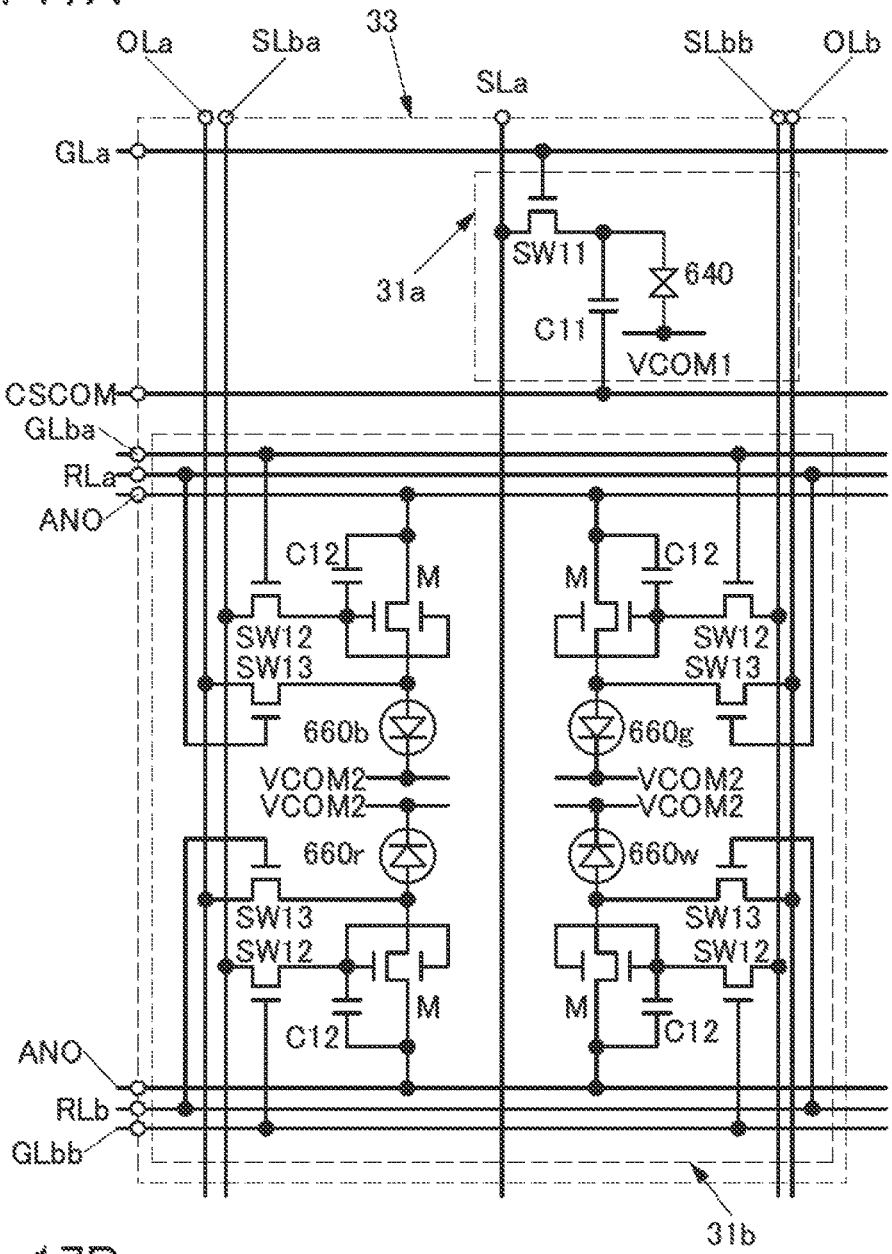
FIGS. 17A and 17B each illustrate a configuration example of a pixel unit.

Although FIG. 16 illustrates an example in which one liquid crystal element 640 and one light-emitting element 660 are provided in one pixel unit 33, one embodiment of the present invention is not limited thereto. FIG. 17A illustrates an example in which one liquid crystal element 640 and four light-emitting elements 660 (light-emitting elements 660*r*, 660*g*, 660*b*, and 660*w*) are provided in one pixel unit 33. The pixel 31*b* illustrated in FIG. 17A differs from that in FIG. 16 in being capable of displaying a full-color image with the use of the light-emitting elements by one pixel.

In FIG. 17A, a wiring GLba, a wiring GLbb, a wiring SLba, a wiring SLbb, a wiring RLa, a wiring RLb, a wiring OLa, and a wiring OLb are connected to the pixel unit 33.

In the example in FIG. 17A, light-emitting elements emitting red light (R), green light (G), blue light (B), and white light (W) can be used as the four light-emitting elements 660, for example. Furthermore, as the liquid crystal element 640, a reflective liquid crystal element emitting white light can be used. Thus, in the case of performing display in the reflective mode, white display with high reflectivity can be performed. In the case of performing display in the transmissive mode, an image can be displayed with a higher color rendering property at low power consumption.

Figure 17B:
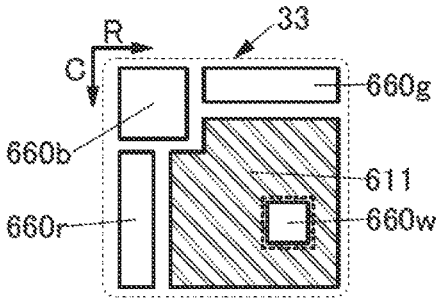

FIG. 17B illustrates a configuration example of the pixel unit 33 corresponding to FIG. 17A. The pixel unit 33 includes the light-emitting element 660*w* overlapping with the opening included in the electrode 611 as well as the light-emitting element 660*r*, the light-emitting element 660*g*, and the light-emitting element 660*b* which are provided around the electrode 611. It is preferable that the light-emitting elements 660*r*, 660*g*, and 660*b* have almost the same light-emitting area.

<Structure Example of Display Device>

Next, structure examples of a display device that can be used for the display portion 13 are described.

Structure Example 1

Figure 18:
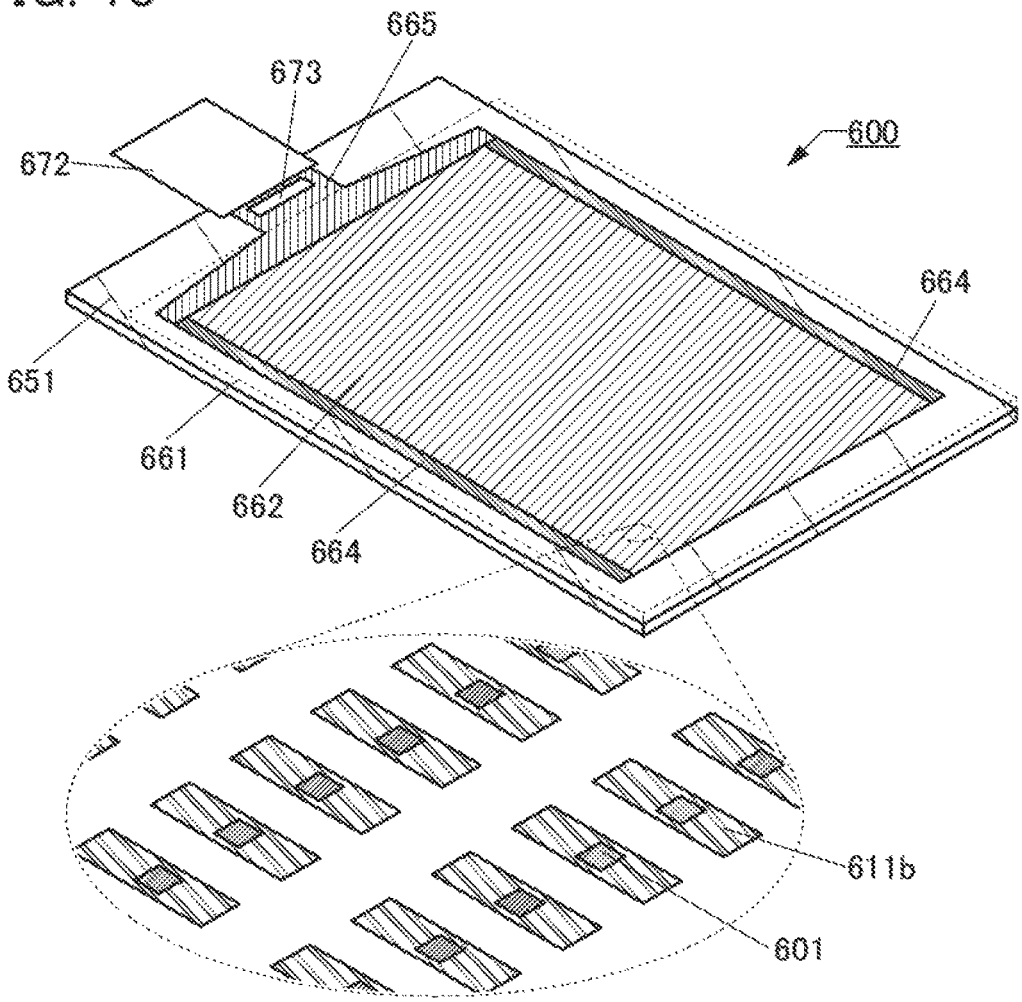
FIG. 18 illustrates a structure example of a display device.

FIG. 18 is a schematic perspective view of a display device 600. In the display device 600, a substrate 651 and a substrate 661 are bonded to each other. In FIG. 18, the substrate 661 is denoted by a dashed line.

The display device 600 includes a display portion 662, a circuit 664, a wiring 665, and the like. FIG. 18 illustrates an example in which the display device 600 is provided with an integrated circuit (IC) 673 and an FPC 672. Thus, the structure illustrated in FIG. 18 can be regarded as a display module including the display device 600, the IC 673, and the FPC 672.

As the circuit 664, for example, a scan line driver circuit can be used.

The wiring 665 has a function of supplying a signal and power to the display portion 662 and the circuit 664. The signal and power are input to the wiring 665 from the outside through the FPC 672 or from the IC 673.

FIG. 18 illustrates an example in which the IC 673 is provided over the substrate 651 by a COG method, a COF method, or the like. An IC including a scan line driver circuit, a signal line driver circuit, or the like can be used as the IC 673, for example. Note that the display device 600 and the display module are not necessarily provided with an IC. The IC may be provided over the FPC by a COF method or the like.

FIG. 18 also illustrates an enlarged view of part of the display portion 662. Electrodes 611*b* included in a plurality of display elements are arranged in a matrix in the display portion 662. The electrode 611*b* has a function of reflecting visible light, and serves as a reflective electrode of a liquid crystal element.

As illustrated in FIG. 18, the electrode 611*b* includes the opening 601. In addition, the display portion 662 includes a light-emitting element that is positioned closer to the substrate 651 than the electrode 611*b* is. Light from the light-emitting element is emitted to the substrate 661 side through the opening 601 in the electrode 611*b*. The area of the light-emitting region of the light-emitting element may be equal to the area of the opening 601. One of the area of the light-emitting region of the light-emitting element and the area of the opening 601 is preferably larger than the other because a margin for misalignment can be increased. It is particularly preferable that the area of the opening 601 be larger than the area of the light-emitting region of the light-emitting element. When the area of the opening 601 is small, part of light from the light-emitting element is blocked by the electrode 611*b* and cannot be extracted to the outside, in some cases. The opening 601 with a sufficiently large area can reduce waste of light emitted from the light-emitting element.

Figure 19:
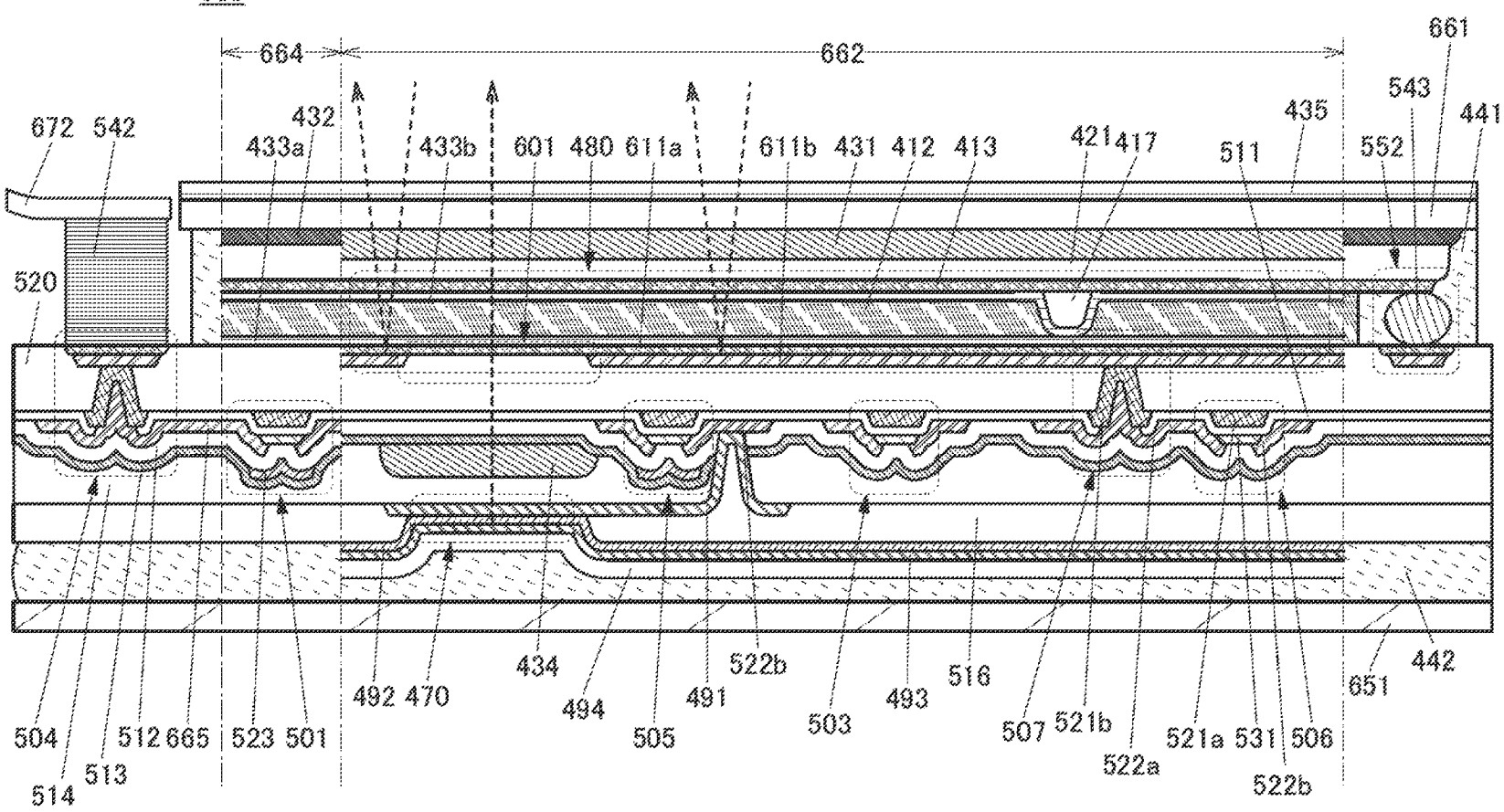
FIG. 19 illustrates a structure example of a display device.

FIG. 19 illustrates an example of cross sections of part of a region including the FPC 672, part of a region including the circuit 664, and part of a region including the display portion 662 of the display device 600 illustrated in FIG. 18.

The display device 600 illustrated in FIG. 19 includes a transistor 501, a transistor 503, a transistor 505, a transistor 506, a liquid crystal element 480, a light-emitting element 470, an insulating layer 520, a coloring layer 431, a coloring layer 434, and the like between the substrate 651 and the substrate 661. The substrate 661 is bonded to the insulating layer 520 with an adhesive layer 441. The substrate 651 is bonded to the insulating layer 520 with an adhesive layer 442.

The substrate 661 is provided with the coloring layer 431, a light-blocking layer 432, an insulating layer 421, an electrode 413 functioning as a common electrode of the liquid crystal element 480, an alignment film 433*b*, an insulating layer 417, and the like. A polarizing plate 435 is provided on an outer surface of the substrate 661. The insulating layer 421 may function as a planarization layer. The insulating layer 421 enables the electrode 413 to have a substantially flat surface, resulting in a uniform alignment state of a liquid crystal layer 412. The insulating layer 417 serves as a spacer for holding a cell gap of the liquid crystal element 480. In the case where the insulating layer 417 transmits visible light, the insulating layer 417 may be positioned to overlap with a display region of the liquid crystal element 480.

The liquid crystal element 480 is a reflective liquid crystal element. The liquid crystal element 480 has a stacked-layer structure of an electrode 611*a* functioning as a pixel electrode, the liquid crystal layer 412, and the electrode 413. The electrode 611*b* that reflects visible light is provided in contact with a surface of the electrode 611*a* on the substrate 651 side. The electrode 611*b* includes the opening 601. The electrode 611*a* and the electrode 413 transmit visible light. An alignment film 433*a* is provided between the liquid crystal layer 412 and the electrode 611*a*. The alignment film 433*b* is provided between the liquid crystal layer 412 and the electrode 413.

In the liquid crystal element 480, the electrode 611*b* has a function of reflecting visible light, and the electrode 413 has a function of transmitting visible light. Light entering from the substrate 661 side is polarized by the polarizing plate 435, transmitted through the electrode 413 and the liquid crystal layer 412, and reflected by the electrode 611*b*. Then, the light is transmitted through the liquid crystal layer 412 and the electrode 413 again to reach the polarizing plate 435. In this case, alignment of liquid crystals can be controlled with a voltage that is applied between the electrode 611*b* and the electrode 413, and thus optical modulation of light can be controlled. In other words, the intensity of light emitted through the polarizing plate 435 can be controlled. Light excluding light in a particular wavelength region is absorbed by the coloring layer 431, and thus, emitted light is red light, for example.

As illustrated in FIG. 19, the electrode 611*a* that transmits visible light is preferably provided across the opening 601. Accordingly, liquid crystals are aligned in a region overlapping with the opening 601 as in the other regions, in which case an alignment defect of the liquid crystals is prevented from being generated in a boundary portion of these regions and undesired light leakage can be suppressed.

At a connection portion 507, the electrode 611*b* is connected to a conductive layer 522*a* included in the transistor 506 via a conductive layer 521*b*. The transistor 506 has a function of controlling the driving of the liquid crystal element 480.

A connection portion 552 is provided in part of a region where the adhesive layer 441 is provided. In the connection portion 552, a conductive layer obtained by processing the same conductive film as the electrode 611*a* is connected to part of the electrode 413 with a connector 543. Accordingly, a signal or a potential input from the FPC 672 connected to the substrate 651 side can be supplied to the electrode 413 formed on the substrate 661 side through the connection portion 552.

As the connector 543, a conductive particle can be used, for example. As the conductive particle, a particle of an organic resin, silica, or the like coated with a metal material can be used. It is preferable to use nickel or gold as the metal material because contact resistance can be decreased. It is also preferable to use a particle coated with layers of two or more kinds of metal materials, such as a particle coated with nickel and further with gold. As the connector 543, a material capable of elastic deformation or plastic deformation is preferably used. As illustrated in FIG. 19, the connector 543, which is the conductive particle, has a shape that is vertically crushed in some cases. With the crushed shape, the contact area between the connector 543 and a conductive layer electrically connected to the connector 543 can be increased, thereby reducing contact resistance and suppressing the generation of problems such as disconnection.

The connector 543 is preferably provided so as to be covered with the adhesive layer 441. For example, the connectors 543 are dispersed in the adhesive layer 441 before curing of the adhesive layer 441.

The light-emitting element 470 is a bottom-emission light-emitting element. The light-emitting element 470 has a stacked-layer structure in which an electrode 491 serving as a pixel electrode, an EL layer 492, and an electrode 493 serving as a common electrode are stacked in this order from the insulating layer 520 side. The electrode 491 is connected to a conductive layer 522*b* included in the transistor 505 through an opening provided in an insulating layer 514. The transistor 505 has a function of controlling the driving of the light-emitting element 470. An insulating layer 516 covers an end portion of the electrode 491. The electrode 493 includes a material that reflects visible light, and the electrode 491 includes a material that transmits visible light. An insulating layer 494 is provided to cover the electrode 493. Light is emitted from the light-emitting element 470 to the substrate 661 side through the coloring layer 434, the insulating layer 520, the opening 601, the electrode 611*a*, and the like.

The liquid crystal element 480 and the light-emitting element 470 can exhibit various colors when the color of the coloring layer varies among pixels. The display device 600 can display a color image using the liquid crystal element 480. The display device 600 can display a color image using the light-emitting element 470.

The transistor 501, the transistor 503, the transistor 505, and the transistor 506 are formed on a plane of the insulating layer 520 on the substrate 651 side. These transistors can be fabricated using the same process.

A circuit connected to the liquid crystal element 480 and a circuit connected to the light-emitting element 470 are preferably formed on the same plane. In that case, the thickness of the display device can be smaller than that in the case where the two circuits are formed on different planes. Furthermore, since two transistors can be formed in the same process, a manufacturing process can be simplified as compared to the case where two transistors are formed on different planes.

The pixel electrode of the liquid crystal element 480 is positioned on the opposite side of a gate insulating layer included in the transistor from the pixel electrode of the light-emitting element 470.

In the case where an OS transistor is used as the transistor 506 or a memory element connected to the transistor 506 is used, for example, a gray level can be maintained even when writing operation to the pixel is stopped while a still image is displayed using the liquid crystal element 480. That is, display can be maintained even when the frame rate is set to an extremely small value. In one embodiment of the present invention, the frame rate can be extremely low and driving with low power consumption can be performed.

The transistor 503 is used for controlling whether the pixel is selected or not (such a transistor is also referred to as a switching transistor or a selection transistor). The transistor 50 is used for controlling current flowing to the light-emitting element 470 (such a transistor is also referred to as a driving transistor).

Insulating layers such as an insulating layer 511, an insulating layer 512, an insulating layer 513, and the insulating layer 514 are provided on the substrate 651 side of the insulating layer 520. Part of the insulating layer 511 functions as a gate insulating layer of each transistor. The insulating layer 512 is provided to cover the transistor 506 and the like. The insulating layer 513 is provided to cover the transistor 505 and the like. The insulating layer 514 functions as a planarization layer. Note that the number of insulating layers covering the transistor is not limited and may be one or two or more.

A material through which impurities such as water and hydrogen do not easily diffuse is preferably used for at least one of the insulating layers that cover the transistors. This is because such an insulating layer can serve as a barrier film. Such a structure can effectively suppress diffusion of the impurities into the transistors from the outside, and a highly reliable display device can be achieved.

Each of the transistors 501, 503, 505, and 506 includes a conductive layer 521*a* functioning as a gate, the insulating layer 511 functioning as a gate insulating layer, the conductive layer 522*a* and the conductive layer 522*b* functioning as a source and a drain, and a semiconductor layer 531. Here, a plurality of layers obtained by processing the same conductive film are shown with the same hatching pattern.

The transistor 501 and the transistor 505 each include a conductive layer 523 functioning as a gate, in addition to the components of the transistor 503 or the transistor 506.

The structure in which the semiconductor layer including a channel formation region is provided between two gates is used as an example of the transistors 501 and 505. Such a structure enables the control of the threshold voltages of the transistors. The two gates may be connected to each other and supplied with the same signal to operate the transistors. Such transistors can have higher field-effect mobility and thus have higher on-state current than other transistors. Consequently, a circuit capable of high-speed operation can be obtained. Furthermore, the area occupied by a circuit portion can be reduced. The use of the transistor having high on-state current can reduce signal delay in wirings and can reduce display unevenness even in a display device in which the number of wirings is increased because of increase in size or definition.

Alternatively, by supplying a potential for controlling the threshold voltage to one of the two gates and a potential for driving to the other, the threshold voltage of the transistors can be controlled.

The structure of the transistors included in the display device is not limited. The transistor included in the circuit 664 and the transistor included in the display portion 662 may have the same structure or different structures. A plurality of transistors included in the circuit 664 may have the same structure or a combination of two or more kinds of structures. Similarly, a plurality of transistors included in the display portion 662 may have the same structure or a combination of two or more kinds of structures.

It is preferable to use a conductive material containing an oxide for the conductive layer 523. A conductive film used for the conductive layer 523 is formed in an oxygen-containing atmosphere, whereby oxygen can be supplied to the insulating layer 512. The proportion of an oxygen gas in a deposition gas is preferably higher than or equal to 90% and lower than or equal to 100%. Oxygen supplied to the insulating layer 512 is supplied to the semiconductor layer 531 by later heat treatment, so that oxygen vacancies in the semiconductor layer 531 can be reduced.

It is particularly preferable to use a low-resistance metal oxide for the conductive layer 523. In that case, an insulating film that releases hydrogen, such as a silicon nitride film is preferably used for the insulating layer 513, for example, because hydrogen can be supplied to the conductive layer 523 during the formation of the insulating layer 513 or by heat treatment performed after the formation of the insulating layer 513, which leads to an effective reduction in the electric resistance of the conductive layer 523.

The coloring layer 434 is provided in contact with the insulating layer 513. The coloring layer 434 is covered with the insulating layer 514.

A connection portion 504 is provided in a region where the substrates 651 and 661 do not overlap with each other. In the connection portion 504, the wiring 665 is connected to the FPC 672 via a connection layer 542. The connection portion 504 has a structure similar to that of the connection portion 507. On the top surface of the connection portion 504, a conductive layer obtained by processing the same conductive film as the electrode 611*a* is exposed. Thus, the connection portion 504 and the FPC 672 can be connected to each other via the connection layer 542.

As the polarizing plate 435 provided on the outer surface of the substrate 661, a linear polarizing plate or a circularly polarizing plate can be used. An example of a circularly polarizing plate is a stack including a linear polarizing plate and a quarter-wave retardation plate. Such a structure can reduce reflection of external light. The cell gap, alignment, drive voltage, and the like of the liquid crystal element used as the liquid crystal element 480 are controlled depending on the kind of the polarizing plate so that desirable contrast is obtained.

Note that a variety of optical members can be arranged on the outer surface of the substrate 661. Examples of the optical members include a polarizing plate, a retardation plate, a light diffusion layer (e.g., a diffusion film), an anti-reflective layer, and a light-condensing film. Furthermore, an antistatic film preventing the attachment of dust, a water repellent film suppressing the attachment of stain, a hard coat film suppressing a scratch in use, or the like may be arranged on the outer surface of the substrate 661.

For each of the substrates 651 and 661, glass, quartz, ceramic, sapphire, an organic resin, or the like can be used. When the substrates 651 and 661 are formed using a flexible material, the flexibility of the display device can be increased.

In the case where the reflective liquid crystal element is used, the polarizing plate 435 is provided on the display surface side. In addition, a light diffusion plate is preferably provided on the display surface side to improve visibility.

A front light may be provided on the outer side of the polarizing plate 435. As the front light, an edge-light front light is preferably used. A front light including a light-emitting diode (LED) is preferably used to reduce power consumption.

Structure Example 2

Figure 20:
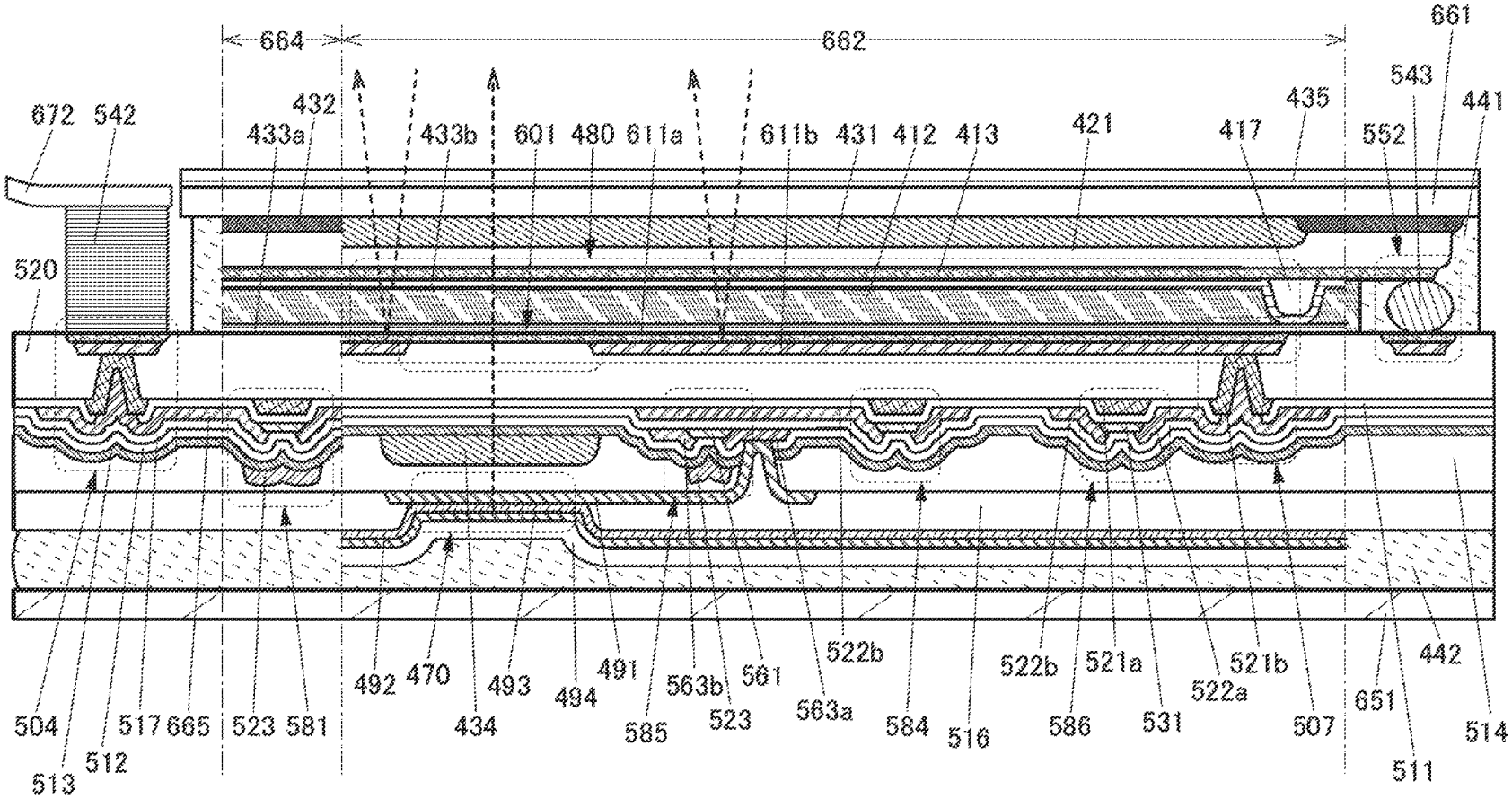
FIG. 20 illustrates a structure example of a display device.

A display device 600A illustrated in FIG. 20 is different from the display device 600 mainly in that a transistor 581, a transistor 584, a transistor 585, and a transistor 586 are included instead of the transistor 501, the transistor 503, the transistor 505, and the transistor 506.

Note that the positions of the insulating layer 417, the connection portion 507, and the like in FIG. 20 are different from those in FIG. 19. FIG. 20 illustrates an end portion of a pixel. The insulating layer 417 is provided so as to overlap with an end portion of the coloring layer 431 and an end portion of the light-blocking layer 432. As in this structure, the insulating layer 417 may be provided in a region not overlapping with a display region (or in a region overlapping with the light-blocking layer 432).

Two transistors included in the display device may partly overlap with each other like the transistor 584 and the transistor 585. In that case, the area occupied by a pixel circuit can be reduced, leading to an increase in resolution. Furthermore, the light-emitting area of the light-emitting element 470 can be increased, leading to an improvement in aperture ratio. The light-emitting element 470 with a high aperture ratio requires low current density to obtain necessary luminance; thus, the reliability is improved.

Each of the transistors 581, 584, and 586 includes the conductive layer 521*a*, the insulating layer 511, the semiconductor layer 531, the conductive layer 522*a*, and the conductive layer 522*b*. The conductive layer 521*a* overlaps with the semiconductor layer 531 with the insulating layer 511 positioned therebetween. The conductive layer 522*a* and the conductive layer 522*b* are electrically connected to the semiconductor layer 531. The transistor 581 includes the conductive layer 523.

The transistor 585 includes the conductive layer 522*b*, an insulating layer 517, a semiconductor layer 561, the conductive layer 523, the insulating layer 512, the insulating layer 513, a conductive layer 563*a*, and a conductive layer 563*b*. The conductive layer 522*b* overlaps with the semiconductor layer 561 with the insulating layer 517 positioned therebetween. The conductive layer 523 overlaps with the semiconductor layer 561 with the insulating layers 512 and 513 positioned therebetween. The conductive layer 563*a* and the conductive layer 563*b* are electrically connected to the semiconductor layer 561.

The conductive layer 521*a* functions as a gate. The insulating layer 511 functions as a gate insulating layer. The conductive layer 522*a* functions as one of a source and a drain. The conductive layer 522*b* functions as the other of the source and the drain.

The conductive layer 522*b* shared by the transistor 584 and the transistor 585 has a portion functioning as the other of a source and a drain of the transistor 584 and a portion functioning as a gate of the transistor 585. The insulating layer 517, the insulating layer 512, and the insulating layer 513 function as gate insulating layers. One of the conductive layers 563*a* and 563*b* functions as a source, and the other functions as a drain. The conductive layer 523 functions as a gate.

Structure Example 3

Figure 21:
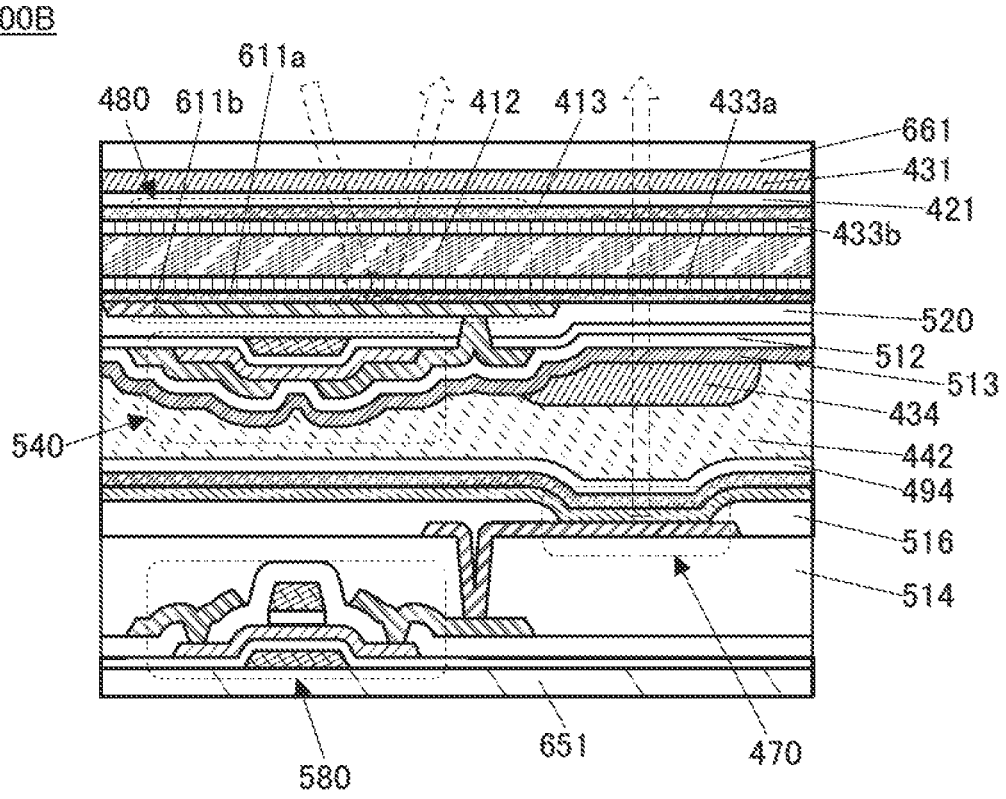
FIG. 21 illustrates a structure example of a display device.

FIG. 21 is a cross-sectional view illustrating a display portion of a display device 600B.

The display device 600B illustrated in FIG. 21 includes a transistor 540, a transistor 580, the liquid crystal element 480, the light-emitting element 470, the insulating layer 520, the coloring layer 431, the coloring layer 434, and the like between the substrate 651 and the substrate 661.

In the liquid crystal element 480, the electrode 611*b* reflects external light to the substrate 661 side. The light-emitting element 470 emits light to the substrate 661 side.

The substrate 661 is provided with the coloring layer 431, the insulating layer 421, the electrode 413 functioning as a common electrode of the liquid crystal element 480, and the alignment film 433*b*.

The liquid crystal layer 412 is provided between the electrode 611*a* and the electrode 413 with the alignment film 433*a* and the alignment film 433*b* positioned therebetween.

The transistor 540 is covered with the insulating layer 512 and the insulating layer 513. The insulating layer 513 and the coloring layer 434 are bonded to the insulating layer 494 with the adhesive layer 442.

In the display device 600B, the transistor 540 for driving the liquid crystal element 480 and the transistor 580 for driving the light-emitting element 470 are formed over different planes; thus, each of the transistors can be easily formed using a structure and a material suitable for driving the corresponding display element.

This embodiment can be combined with any of the other embodiments as appropriate.

Embodiment 4

In this embodiment, a specific configuration example of the control portion is described. Note that in this example, the display portion 13 includes a plurality of pixel groups 32.

Figure 22:
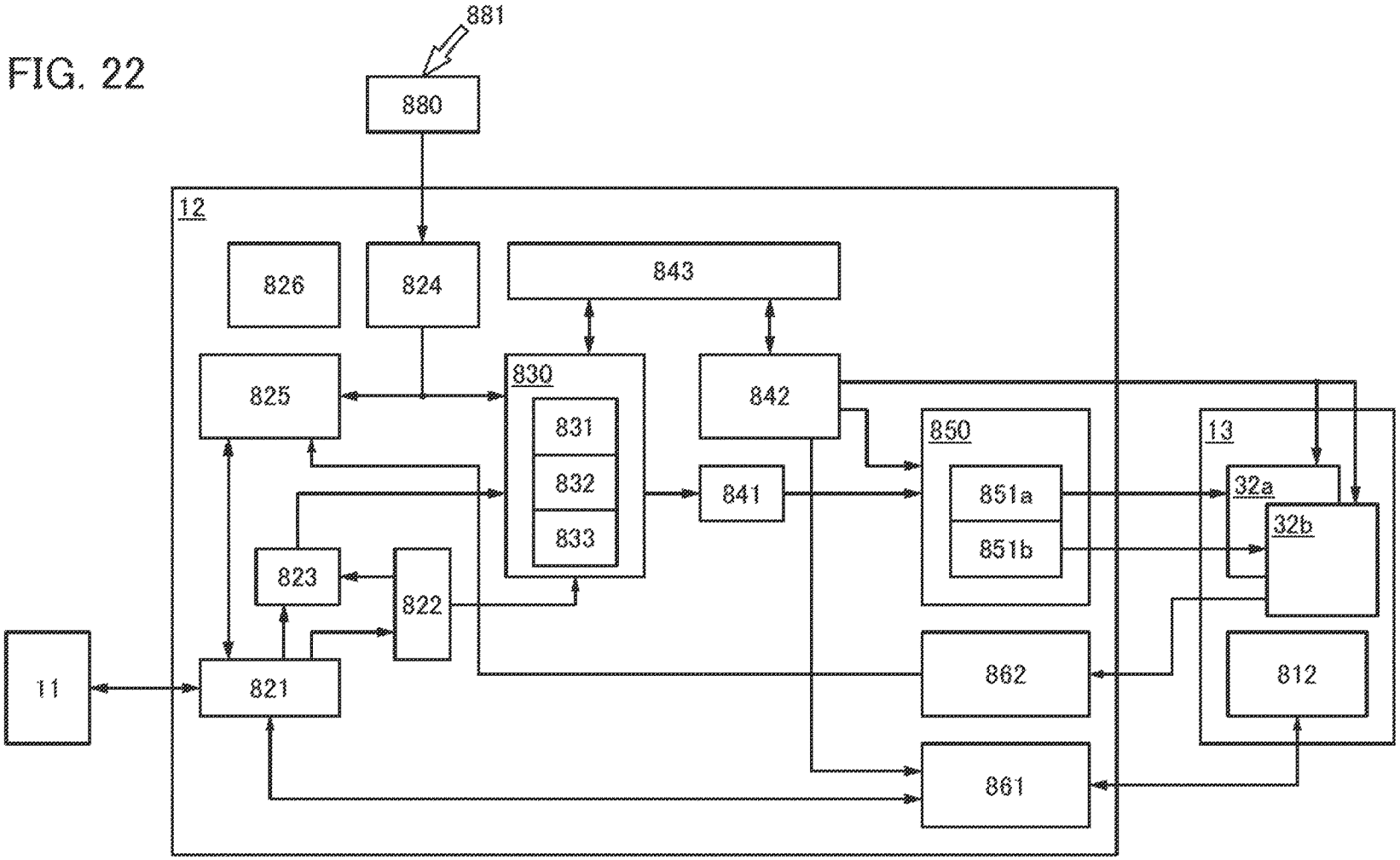
FIG. 22 illustrates a configuration example of a control portion.

FIG. 22 illustrates a configuration example of the control portion 12. The control portion 12 includes an interface 821, a frame memory 822, a decoder 823, a sensor controller 824, a controller 825, a clock generation circuit 826, an image processing portion 830, a memory device 841, a timing controller 842, a register 843, a driver circuit 850, a touch sensor controller 861, and an examination circuit 862. The interface 821, the controller 825, and the examination circuit 862 correspond to the interfaces 20 and 21, the controller 22, and the examination circuit 25 in FIG. 1A, respectively.

The display portion 13 includes the pixel group 32*a* and the pixel group 32*b*. FIG. 22 illustrates, as an example, a configuration in which the display portion 13 includes the pixel group 32*a* that performs display using a reflective liquid crystal element and the pixel group 32*b* that performs display using a light-emitting element. In addition, the display portion 13 may include a touch sensor unit 812 having a function of obtaining information on whether touch operation is performed or not, touch position, or the like. In the case where the display portion 13 does not include the touch sensor unit 812, the touch sensor controller 861 can be omitted.

The driver circuit 850 includes a source driver 851. The source driver 851 is a circuit having a function of supplying a video signal to the pixel group 32. Since the display portion 13 includes the pixel groups 32*a* and 32*b* in FIG. 22, the driver circuit 850 includes source drivers 851*a* and 851*b*. The source drivers 851*a* and 851*b* correspond to the driver circuits 24*a* and 24*b* in FIG. 12, respectively.

Information on whether touch operation is performed or not, touch position, or the like obtained by the touch sensor controller 861 is transmitted from the control portion 12 to the transmitting portion 11. Note that the circuits included in the control portion 12 can be selected as appropriate in accordance with the standard of the transmitting portion 11, the specifications of the display portion 13, and the like.

The frame memory 822 is a memory circuit having a function of storing image data input to the control portion 12. In the case where compressed image data is transmitted from the transmitting portion 11 to the control portion 12, the frame memory 822 can store the compressed image data. The decoder 823 is a circuit for decompressing the compressed image data. When decompression of the image data is not needed, processing is not performed in the decoder 823. Note that the decoder 823 can be provided between the frame memory 822 and the interface 821.

The image processing portion 830 has a function of performing various kinds of image processing on image data input from the frame memory 822 or the decoder 823 and generating a video signal. For example, the image processing portion 830 includes a gamma correction circuit 831, a dimming circuit 832, and a toning circuit 833.

A video signal generated in the image processing portion 830 is output to the driver circuit 850 through the memory device 841. The memory device 841 has a function of temporarily storing image data. The source drivers 851*a* and 851*b* have a function of performing various kinds of processing on video signals input from the memory device 841 and outputting the signals to the pixel groups 32*a* and 32*b*.

The timing controller 842 has a function of generating timing signals and the like used in the driver circuit 850, the touch sensor controller 861, and the driver circuit included in the pixel group 32.

The touch sensor controller 861 has a function of controlling the operation of the touch sensor unit 812. A signal including touch information sensed by the touch sensor unit 812 is processed in the touch sensor controller 861 and transmitted to the transmitting portion 11 via the interface 821. The transmitting portion 11 generates image data reflecting the touch information and transmits the image data to the control portion 12. The control portion 12 may reflect the touch information in the image data. The touch sensor controller 861 may be provided in the touch sensor unit 812.

The clock generation circuit 826 has a function of generating a clock signal used in the control portion 12. The controller 825 has a function of processing a variety of control signals transmitted from the transmitting portion 11 through the interface 821 and controlling a variety of circuits in the control portion 12. The controller 825 also has a function of controlling power supply to the variety of circuits in the control portion 12. For example, the controller 825 can temporarily interrupt the power supply to a circuit that is not driven.

The register 843 has a function of storing data used for the operation of the control portion 12. Examples of the data stored in the register 843 include a parameter used to perform correction processing in the image processing portion 830 and parameters used to generate waveforms of a variety of timing signals in the timing controller 842. The register 843 includes a scan chain register including a plurality of registers.

The sensor controller 824 connected to a photosensor 880 can be provided in the control portion 12. The photosensor 880 has a function of sensing external light 881 and generating a sensing signal. The sensor controller 824 has a function of generating a control signal on the basis of the sensing signal. The control signal generated in the sensor controller 824 is output to the controller 825, for example.

The image processing portion 830 has a function of separately generating a video signal of the pixel group 32*a* and a video signal of the pixel group 32*b*. In that case, the reflection intensity of the reflective liquid crystal element included in the pixel group 32*a* and the emission intensity of the light-emitting element included in the pixel group 32*b* can be adjusted in response to the brightness of the external light 881 measured using the photosensor 880 and the sensor controller 824. Here, the adjustment can be referred to as dimming or dimming treatment. In addition, a circuit that performs the dimming treatment is referred to as a dimming circuit.

The image processing portion 830 may include another processing circuit such as an RGB-RGBW conversion circuit depending on the specifications of the display portion 13. The RGB-RGBW conversion circuit has a function of converting image data of red, green, and blue (RGB) into image signals of red, green, blue, and white (RGBW). That is, in the case where the display portion 13 includes pixels of four colors of RGBW, power consumption can be reduced by displaying a white (W) component in the image data using the white (W) pixel. Note that in the case where the display portion 13 includes pixels of four colors of RGBY an RGB-RGBY (red, green, blue, and yellow) conversion circuit can be used, for example.

This embodiment can be combined with any of the other embodiments as appropriate.

Embodiment 5

In this embodiment, a structure example of an OS transistor that can be used in the above embodiment is described.

Structure Example of Transistor

Structure Example 1

Figure 23A:
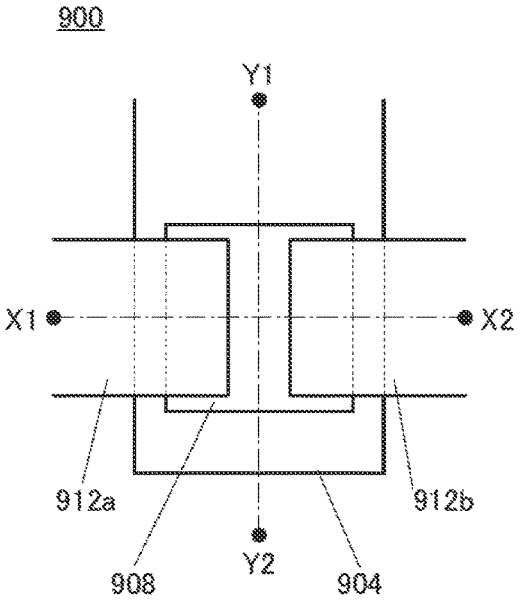
FIGS. 23A to 23D illustrate a structure example of a transistor.

FIG. 23A is a top view of a transistor 900. FIG. 23C is a cross-sectional view taken along line X1-X2 in FIG. 23A. FIG. 23D is a cross-sectional view taken along line Y1-Y2 in FIG. 23A. Note that in FIG. 23A, some components of the transistor 900 (e.g., an insulating film serving as a gate insulating film) are not illustrated to avoid complexity. In some cases, the direction of line X1-X2 is referred to as a channel length direction and the direction of line Y1-Y2 is referred to as a channel width direction. As in FIG. 23A, some components are not illustrated in some cases in top views of transistors described below.

The transistor 900 includes a conductive film 904 functioning as a gate electrode over a substrate 902, an insulating film 906 over the substrate 902 and the conductive film 904, an insulating film 907 over the insulating film 906, a metal oxide film 908 over the insulating film 907, a conductive film 912*a* functioning as a source electrode connected to the metal oxide film 908, and a conductive film 912*b* functioning as a drain electrode connected to the metal oxide film 908. Over the transistor 900, specifically, over the conductive films 912*a* and 912*b* and the metal oxide film 908, an insulating film 914, an insulating film 916, and an insulating film 918 are provided. The insulating films 914, 916, and 918 function as a protective insulating film for the transistor 900.

The metal oxide film 908 includes a first metal oxide film 908*a* on the conductive film 904 side and a second metal oxide film 908*b* over the first metal oxide film 908*a*. The insulating films 906 and 907 function as a gate insulating film of the transistor 900.

An In-M oxide (M is Ti, Ga, Sn, Y, Zr, La, Ce, Nd, or Hf) or an In-M-Zn oxide can be used for the metal oxide film 908. It is particularly preferable to use an In-M-Zn oxide for the metal oxide film 908.

The first metal oxide film 908*a* includes a first region in which the atomic proportion of In is larger than the atomic proportion of M. The second metal oxide film 908*b* includes a second region in which the atomic proportion of In is smaller than that in the first metal oxide film 908*a*. The second region includes a portion thinner than the first region.

The first metal oxide film 908*a* including the first region in which the atomic proportion of In is larger than that of M can increase the field-effect mobility (also simply referred to as mobility or μFE) of the transistor 900. Specifically, the field-effect mobility of the transistor 900 can exceed 10 $cm^2/Vs$.

For example, the use of the transistor with high field-effect mobility for a driver circuit that generates a selection signal (specifically, a demultiplexer connected to an output terminal of a shift register included in the driver circuit) allows a semiconductor device or a display device to have a narrow frame.

On the other hand, the first metal oxide film 908*a* including the first region in which the atomic proportion of In is larger than that of M makes it easier to change electrical characteristics of the transistor 900 in light irradiation in some cases. However, in the semiconductor device of one embodiment of the present invention, the second metal oxide film 908*b* is formed over the first metal oxide film 908*a*. In addition, the thickness of a channel formation region in the second metal oxide film 908*b* is smaller than the thickness of the first metal oxide film 908*a*.

Furthermore, the second metal oxide film 908*b* includes the second region in which the atomic proportion of In is smaller than that in the first metal oxide film 908*a* and thus has larger Eg than the first metal oxide film 908*a*. For this reason, the metal oxide film 908 that is a layered structure of the first metal oxide film 908*a* and the second metal oxide film 908*b* has high resistance to a negative bias stress test with light irradiation.

The amount of light absorbed by the metal oxide film 908 can be reduced during light irradiation. As a result, the change in electrical characteristics of the transistor 900 due to light irradiation can be reduced. In the semiconductor device of one embodiment of the present invention, the insulating film 914 or the insulating film 916 includes excess oxygen. This structure can further reduce the change in electrical characteristics of the transistor 900 due to light irradiation.

Here, the metal oxide film 908 is described in detail with reference to FIG. 23B.

Figure 23B:
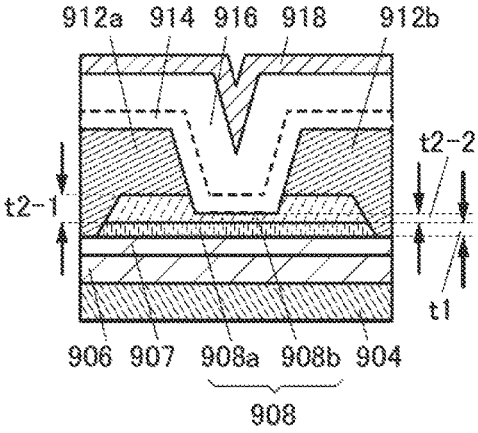
Figure 23C:
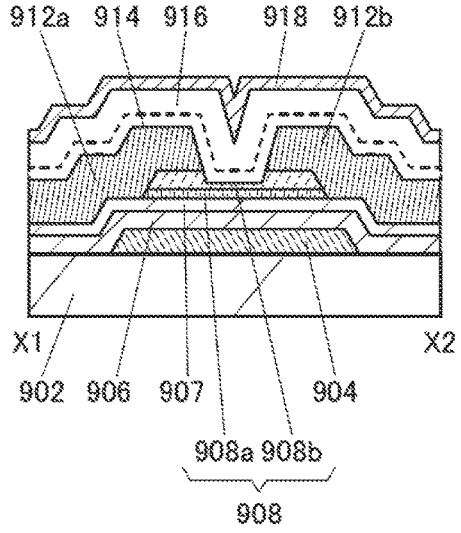
Figure 23D:
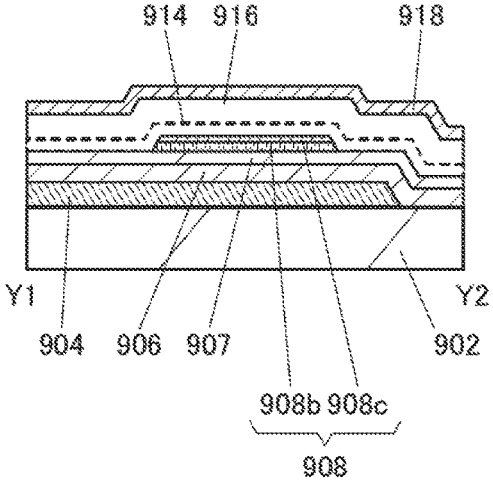

FIG. 23B is an enlarged cross-sectional view of the metal oxide film 908 and the vicinity thereof in the transistor 900 illustrated in FIG. 23C.

In FIG. 23B, t1, t2-1, and t2-2 denote a thickness of the first metal oxide film 908*a*, one thickness of the second metal oxide film 908*b*, and the other thickness of the second metal oxide film 908*b*, respectively. The second metal oxide film 908*b* over the first metal oxide film 908*a* prevents the first metal oxide film 908*a* from being exposed to an etching gas, an etchant, or the like when the conductive films 912*a* and 912*b* are formed. This is why the first metal oxide film 908*a* is not or is hardly reduced in thickness. In contrast, in the second metal oxide film 908*b*, a portion not overlapping with the conductive films 912*a* and 912*b* is etched by formation of the conductive films 912*a* and 912*b*, so that a depression is formed in the etched region. In other words, a thickness of the second metal oxide film 908*b* in a region overlapping with the conductive films 912*a* and 912*b* is t2-1, and a thickness of the second metal oxide film 908*b* in a region not overlapping with the conductive films 912*a* and 912*b* is t2-2.

As for the relationships between the thicknesses of the first metal oxide film 908*a* and the second metal oxide film 908*b*, t2-1>t1>t2-2 is preferable. A transistor with the thickness relationships can have high field-effect mobility and less variation in threshold voltage in light irradiation.

When oxygen vacancies are formed in the metal oxide film 908 included in the transistor 900, electrons serving as carriers are generated; as a result, the transistor 900 tends to be normally-on. Therefore, for stable transistor characteristics, it is important to reduce oxygen vacancies in the metal oxide film 908, particularly oxygen vacancies in the first metal oxide film 908*a*. In the structure of the transistor of one embodiment of the present invention, excess oxygen is introduced into an insulating film over the metal oxide film 908, here, the insulating film 914 and/or the insulating film 916 over the metal oxide film 908, whereby oxygen is moved from the insulating film 914 and/or the insulating film 916 to the metal oxide film 908 to fill oxygen vacancies in the metal oxide film 908, particularly in the first metal oxide film 908*a*.

Note that it is preferable that the insulating films 914 and 916 each include a region (oxygen excess region) including oxygen in excess of that in the stoichiometric composition. In other words, the insulating films 914 and 916 are insulating films capable of releasing oxygen. Note that the oxygen excess region is formed in the insulating films 914 and 916 in such a manner that oxygen is introduced into the insulating films 914 and 916 after the deposition, for example. Oxygen can be introduced by an ion implantation method, an ion doping method, a plasma immersion ion implantation method, plasma treatment, or the like.

In order to fill oxygen vacancies in the first metal oxide film 908*a*, the thickness of the portion including the channel formation region and the vicinity of the channel formation region in the second metal oxide film 908*b* is preferably small, and t2-2<t1 is preferably satisfied. For example, the thickness of the portion including the channel formation region and the vicinity of the channel formation region in the second metal oxide film 908*b* is preferably greater than or equal to 1 nm and less than or equal to 20 nm, further preferably greater than or equal to 3 nm and less than or equal to 10 nm.

Structure Example 2

Figure 24A:
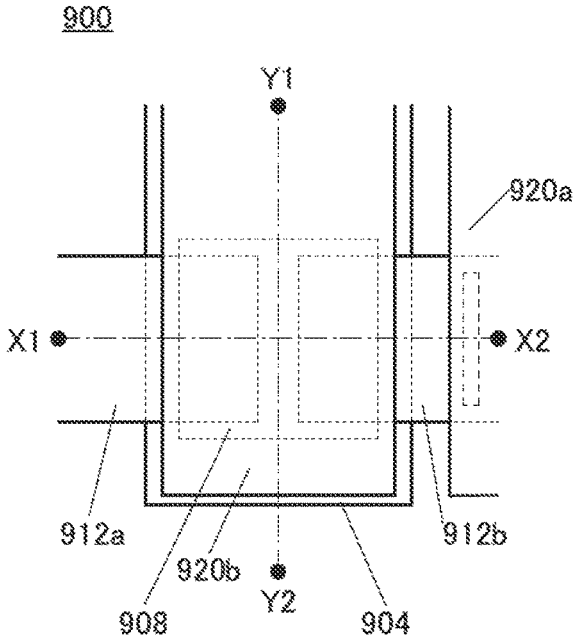
FIGS. 24A to 24C illustrate a structure example of a transistor.
Figure 24B:
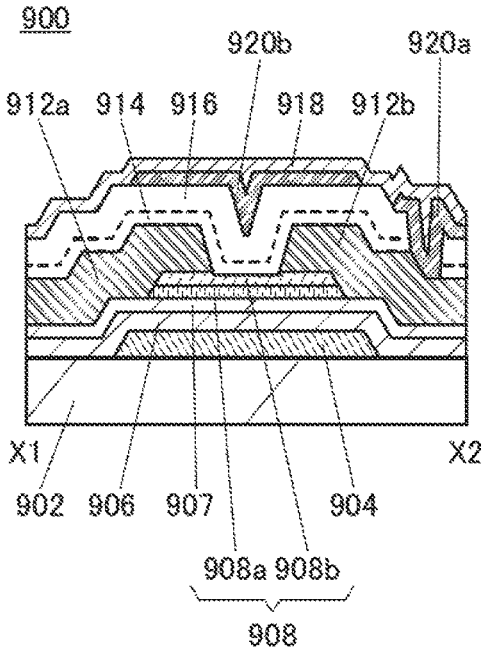
Figure 24C:
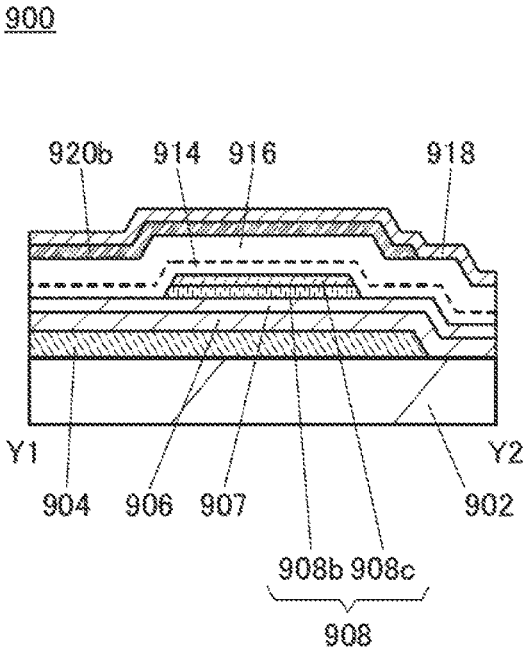

FIGS. 24A to 24C illustrate another structure example of the transistor 900. FIG. 24A is a top view of the transistor 900. FIG. 24B is a cross-sectional view taken along line X1-X2 in FIG. 24A, and FIG. 24C is a cross-sectional view taken along line Y I-Y2 in FIG. 24A.

The transistor 900 includes the conductive film 904 functioning as a first gate electrode over the substrate 902, the insulating film 906 over the substrate 902 and the conductive film 904, the insulating film 907 over the insulating film 906, the metal oxide film 908 over the insulating film 907, the conductive film 912*a* functioning as the source electrode electrically connected to the metal oxide film 908, the conductive film 912*b* functioning as the drain electrode electrically connected to the metal oxide film 908, the insulating films 914 and 916 over the metal oxide film 908 and the conductive films 912*a* and 912*b*, a conductive film 920*a* that is over the insulating film 916 and electrically connected to the conductive film 912*b*, a conductive film 920*b* over the insulating film 916, and the insulating film 918 over the insulating film 916 and the conductive films 920*a* and 920*b*.

The conductive film 920*b* can be used as a second gate electrode of the transistor 900. In the case where the transistor 900 is used in a display portion of an input/output device, the conductive film 920*a* can be used as an electrode of a display element, or the like.

The conductive film 920*a* functioning as a conductive film and the conductive film 920*b* functioning as the second gate electrode each include a metal element that is the same as that included in the metal oxide film 908. For example, the conductive film 920*b* functioning as the second gate electrode and the metal oxide film 908 include the same metal element; thus, the manufacturing cost can be reduced.

For example, in the case where the conductive film 920*a* functioning as a conductive film and the conductive film 920*b* functioning as the second gate electrode each include In-M-Zn oxide, the atomic ratio of metal elements in a sputtering target used for forming the In-M-Zn oxide preferably satisfies In In≥M. The atomic ratio of metal elements in such a sputtering target is, for example, In:M:Zn=2:1:3, In:M:Zn=3:1:2, or In:M:Zn=4:2:4.1.

The conductive film 920*a* functioning as a conductive film and the conductive film 920*b* functioning as the second gate electrode can each have a single-layer structure or a stacked-layer structure of two or more layers. Note that in the case where the conductive film 920*a* and the conductive film 920*b* each have a stacked-layer structure, the composition of the sputtering target is not limited to that described above.

In a step of forming the conductive films 920*a* and 920*b*, the conductive films 920*a* and 920*b* serve as a protective film for suppressing release of oxygen from the insulating films 914 and 916. The conductive films 920*a* and 920*b* serve as semiconductors before a step of forming the insulating film 918 and serve as conductors after the step of forming the insulating film 918.

Oxygen vacancies are formed in the conductive films 920*a* and 920*b*, and hydrogen is added from the insulating film 918 to the oxygen vacancies, whereby a donor level is formed in the vicinity of the conduction band. As a result, the conductivity of each of the conductive films 920*a* and 920*b* is increased, so that the conductive films 920*a* and 920*b* become conductors. The conductive films 920*a* and 920*b* having become conductors can each be referred to as an oxide conductor. Oxide semiconductors generally have a visible light transmitting property because of their large energy gap. An oxide conductor is an oxide semiconductor having a donor level in the vicinity of the conduction band. Therefore, the influence of absorption due to the donor level is small in an oxide conductor, and an oxide conductor has a visible light transmitting property comparable to that of an oxide semiconductor.

<Metal Oxide>

Next, a metal oxide that can be used in the OS transistor is described. In particular, the details of a metal oxide and a cloud-aligned composite (CAC)-OS are described below.

A CAC-OS or a CAC metal oxide has a conducting function in part of the material and has an insulating function in another part of the material; as a whole, the CAC-OS or the CAC metal oxide has a function of a semiconductor. In the case where the CAC-OS or the CAC metal oxide is used in a channel formation region of a transistor, the conducting function is to allow electrons (or holes) serving as carriers to flow, and the insulating function is to not allow electrons serving as carriers to flow. By the complementary action of the conducting function and the insulating function, the CAC-OS or the CAC metal oxide can have a switching function (on/off function). In the CAC-OS or CAC metal oxide, separation of the functions can maximize each function.

The CAC-OS or the CAC metal oxide includes conductive regions and insulating regions. The conductive regions have the above-described conducting function, and the insulating regions have the above-described insulating function. In some cases, the conductive regions and the insulating regions in the material are separated at the nanoparticle level. In some cases, the conductive regions and the insulating regions are unevenly distributed in the material. The conductive regions are observed to be coupled in a cloud-like manner with their boundaries blurred, in some cases.

Furthermore, in the CAC-OS or the CAC metal oxide, the conductive regions and the insulating regions each have a size greater than or equal to 0.5 nm and less than or equal to 10 nm, preferably greater than or equal to 0.5 nm and less than or equal to 3 n and are dispersed in the material, in some cases.

The CAC-OS or the CAC metal oxide includes components having different bandgaps. For example, the CAC-OS or the CAC metal oxide includes a component having a wide gap due to the insulating region and a component having a narrow gap due to the conductive region. In the case of such a composition, carriers mainly flow in the component having a narrow gap. The component having a narrow gap complements the component having a wide gap, and carriers also flow in the component having a wide gap in conjunction with the component having a narrow gap. Therefore, in the case where the above-described CAC-OS or the CAC metal oxide is used in a channel formation region of a transistor, high current drive capability in the on state of the transistor, that is, a high on-state current and high field-effect mobility, can be obtained.

In other words, the CAC-OS or the CAC metal oxide can be called a matrix composite or a metal matrix composite.

The CAC-OS has, for example, a composition in which elements included in a metal oxide are unevenly distributed. Materials including unevenly distributed elements each have a size of greater than or equal to 0.5 nm and less than or equal to 10 nm, preferably greater than or equal to 1 nm and less than or equal to 2 nm, or a similar size. Note that in the following description of a metal oxide, a state in which one or more metal elements are unevenly distributed and regions including the metal element(s) are mixed is referred to as a mosaic pattern or a patch-like pattern. The regions each have a size greater than or equal to 0.5 nm and less than or equal to 10 nm, preferably greater than or equal to 1 nm and less than or equal to 2 nm, or a similar size.

Note that a metal oxide preferably contains at least indium. In particular, indium and zinc are preferably contained. In addition, one or more of aluminum, gallium, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like may be contained.

For example, of the CAC-OS, an In—Ga—Zn oxide with the CAC composition (such an In—Ga—Zn oxide may be particularly referred to as CAC-IGZO) has a composition in which materials are separated into indium oxide (InOn, where X1 is a real number greater than 0) or indium zinc oxide ($In_{X2}Zn_{Y2}O_{Z2}$, where X2, Y2, and Z2 are real numbers greater than 0), and gallium oxide ($GaO_{X3}$, where X3 is a real number greater than 0) or gallium zinc oxide ($Ga_{X4}Zn_{Y4}O_{Z4}$, where X4, Y4, and Z4 are real numbers greater than 0), and a mosaic pattern is formed. Then, $InO_{X1}$ or $In_{X2}Zn_{Y2}O_{Z2}$ forming the mosaic pattern is evenly distributed in the film. This composition is also referred to as a cloud-like composition.

That is, the CAC-OS is a composite metal oxide with a composition in which a region including $GaO_{X3}$ as a main component and a region including $In_{X2}Zn_{Y2}O_{Z2}$ or $InO_{X1}$ as a main component are mixed. Note that in this specification, for example, when the atomic ratio of In to an element M in a first region is greater than the atomic ratio of In to an element M in a second region, the first region has higher In concentration than the second region.

Note that a compound including In, Ga, Zn, and O is also known as IGZO. Typical examples of IGZO include a crystalline compound represented by $InGaO_3(ZnO)_{m1}$ (m1 is a natural number) and a crystalline compound represented by $In_{(1+x0)}Ga_{(1-x0)}O_3(ZnO)_{m0}$ ($-1 \leq x0 \leq 1$; m0 is a given number).

The above crystalline compounds have a single crystal structure, a polycrystalline structure, or a c-axis-aligned crystalline (CAAC) structure. Note that the CAAC structure is a crystal structure in which a plurality of IGZO nanocrystals have c-axis alignment and are connected in the a-b plane direction without alignment.

On the other hand, the CAC-OS relates to the material composition of a metal oxide. In a material composition of a CAC-OS including In, Ga, Zn, and O, nanoparticle regions including Ga as a main component are observed in part of the CAC-OS and nanoparticle regions including In as a main component are observed in part thereof. These nanoparticle regions are randomly dispersed to form a mosaic pattern. Therefore, the crystal structure is a secondary element for the CAC-OS.

Note that in the CAC-OS, a stacked-layer structure including two or more films with different atomic ratios is not included. For example, a two-layer structure of a film including In as a main component and a film including Ga as a main component is not included.

A boundary between the region including $GaO_{X3}$ as a main component and the region including $In_{X2}Zn_{Y2}O_{Z2}$ or $InO_{X1}$ as a main component is not clearly observed in some cases.

In the case where one or more of aluminum, yttrium, copper, vanadium, berylliuim boron, silicon, titanium, iron, nickel, germanium, zirconium, molybdenum, lanthanum, cerium, neodymium, hafnium, tantalum, tungsten, magnesium, and the like are contained instead of gallium in a CAC-OS, nanoparticle regions including the selected metal element(s) as a main component(s) are observed in part of the CAC-OS and nanoparticle regions including In as a main component are observed in part thereof, and these nanoparticle regions are randomly dispersed to form a mosaic pattern in the CAC-OS.

The CAC-OS can be formed by a sputtering method under conditions where a substrate is not heated intentionally, for example. In the case of forming the CAC-OS by a sputtering method, one or more selected from an inert gas (typically, argon), an oxygen gas, and a nitrogen gas may be used as a deposition gas. The ratio of the flow rate of an oxygen gas to the total flow rate of the deposition gas at the time of deposition is preferably as low as possible, and for example, the flow ratio of an oxygen gas is preferably higher than or equal to 0% and lower than 30%, further preferably higher than or equal to 0% and lower than or equal to 10%.

The CAC-OS is characterized in that no clear peak is observed in measurement using θ/2θ scan by an out-of-plane method, which is an X-ray diffraction (XRD) measurement method. That is, X-ray diffraction shows no alignment in the a-b plane direction and the c-axis direction in a measured region.

In an electron diffraction pattern of the CAC-OS which is obtained by irradiation with an electron beam with a probe diameter of 1 nm (also referred to as a nanometer-sized electron beam), a ring-like region with high luminance and a plurality of bright spots in the ring-like region are observed. Therefore, the electron diffraction pattern indicates that the crystal structure of the CAC-OS includes a nanocrystal (nc) structure with no alignment in plan-view and cross-sectional directions.

For example, an energy dispersive X-ray spectroscopy (EDX) mapping image confirms that an In—Ga—Zn oxide with the CAC composition has a structure in which a region including $GaO_{X3}$ as a main component and a region including $In_{X2}Zn_{Y2}O_{Z2}$ or $InO_{X1}$ as a main component are unevenly distributed and mixed.

The CAC-OS has a structure different from that of an IGZO compound in which metal elements are evenly distributed, and has characteristics different from those of the IGZO compound. That is, in the CAC-OS, regions including $GaO_{X3}$ or the like as a main component and regions including $In_{X2}Zn_{Y2}O_{Z2}$ or $InO_{X1}$ as a main component are separated to form a mosaic pattern.

The conductivity of a region including $In_{X2}Zn_{Y2}O_{Z2}$ or $InO_{X1}$ as a main component is higher than that of a region including $GaO_{X3}$ or the like as a main component. In other words, when carriers flow through regions including $In_{X2}Zn_{Y2}O_{Z2}$ or $InO_{X1}$ as a main component, the conductivity of an oxide semiconductor is exhibited. Accordingly, when regions including $In_{X2}Zn_{Y2}O_{Z2}$ or $InO_{X1}$ as a main component are distributed in an oxide semiconductor like a cloud, high field-effect mobility (μ) can be achieved.

In contrast, the insulating property of a region including $GaO_{X3}$ or the like as a main component is higher than that of a region including $In_{X2}Zn_{Y2}O_{Z2}$ or InOn as a main component. In other words, when regions including $GaO_{X3}$ or the like as a main component are distributed in an oxide semiconductor, leakage current can be suppressed and favorable switching operation can be achieved.

Accordingly, when a CAC-OS is used for a semiconductor element, the insulating property derived from $GaO_{X3}$ or the like and the conductivity derived from $In_{X2}Zn_{Y2}O_{Z2}$ or $InO_{X1}$ complement each other, whereby high on-state current ($I_{on}$) and high field-effect mobility (μ) can be achieved.

A semiconductor element including a CAC-OS has high reliability. Thus, the CAC-OS is suitably used in a variety of semiconductor devices.

This embodiment can be combined with any of the other embodiments as appropriate.

Embodiment 6

In this embodiment, other examples of the electronic devices described in the above embodiments are described.

The semiconductor device and the system of one embodiment of the present invention can be used in portable electronic devices, wearable electronic devices (wearable devices), e-book readers, and the like. FIGS. 25A to 25D illustrate examples of electronic devices including the semiconductor device or the system of one embodiment of the present invention.

Figure 25A:
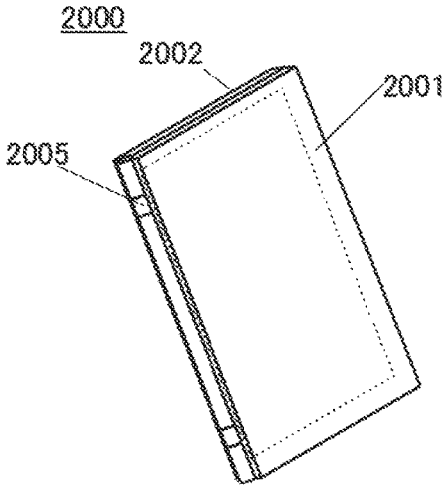
FIGS. 25A to 25D each illustrate a structure example of an electronic device.
Figure 25B:
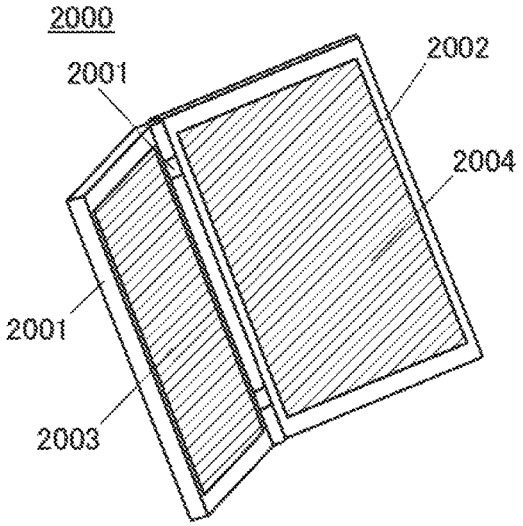

FIGS. 25A and 25B illustrate an example of a portable information terminal 2000. The portable information terminal 2000 includes a housing 2001, a housing 2002, a display portion 2003, a display portion 2004, a hinge portion 2005, and the like.

The housing 2001 and the housing 2002 are connected with the hinge portion 2005. The portable information terminal 2000 folded as in FIG. 25A can be changed into the state illustrated in FIG. 25B, in which the housing 2001 and the housing 2002 are opened.

For example, the portable information terminal 2000 can also be used as an e-book reader, in which the display portion 2003 and the display portion 2004 can each display text data. In addition, the display portion 2003 and the display portion 2004 can each display a still image or a moving image. Furthermore, the display portion 2003 may be provided with a touch panel.

In this manner, the portable information terminal 2000 has high versatility because it can be folded when carried.

Note that the housing 2001 and the housing 2002 may include a power switch, an operation button, an external connection port, a speaker, a microphone, and/or the like.

Note that the portable information terminal 2000 may have a function of identifying a character, a figure, or an image using a touch sensor provided in the display portion 2003. In this case, learning in the following mode becomes possible, for example: an answer is written with a finger, a stylus pen, or the like on an information terminal that displays a workbook or the like for studying mathematics or for learning language, and then the portable information terminal 2000 determines whether the answer is correct or not. The portable information terminal 2000 may have a function of performing speech interpretation. In this case, for example, the portable information terminal 2000 can be used in learning a foreign language. Such a portable information terminal is suitable for use as a teaching material such as a textbook, a notebook, or the like.

Note that the touch information obtained by the touch sensor provided in the display portion 2003 can be used for prediction of the necessity of power supply by the semiconductor device of one embodiment of the present invention.

Figure 25C:
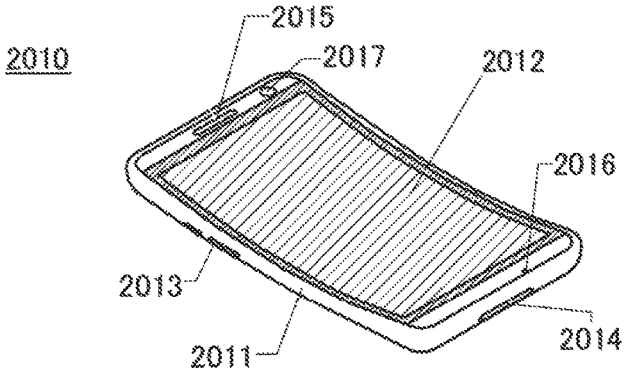

FIG. 25C illustrates an example of a portable information terminal. A portable information terminal 2010 illustrated in FIG. 25C includes a housing 2011, a display portion 2012, an operation button 2013, an external connection port 2014, a speaker 2015, a microphone 2016, a camera 2017, and the like.

The portable information terminal 2010 includes a touch sensor in the display portion 2012. Operations such as making a call and inputting a letter can be performed by touch on the display portion 2012 with a finger, a stylus, or the like.

With the operation buttons 2013, power on or off can be switched. In addition, types of images displayed on the display portion 2012 can be switched; for example, switching images from a mail creation screen to a main menu screen is performed.

When a sensing device such as a gyroscope sensor or an acceleration sensor is provided inside the portable information terminal 2010, the direction of display on the screen of the display portion 2012 can be automatically changed by determining the orientation of the portable information terminal 2010 (whether the portable information terminal 2010 is placed horizontally or vertically). Furthermore, the direction of display on the screen can be changed by touch on the display portion 2012, operation with the operation button 2013, sound input using the microphone 2016, or the like.

The portable information terminal 2010 functions as, for example, one or more of a telephone set, a notebook, and an information browsing system. For example, the portable information terminal 2010 can be used as a smartphone. The portable information terminal 2010 is capable of executing a variety of applications such as mobile phone calls, e-mailing, viewing and editing texts, music reproduction, reproducing a moving image, Internet communication, and computer games, for example.

Figure 25D:
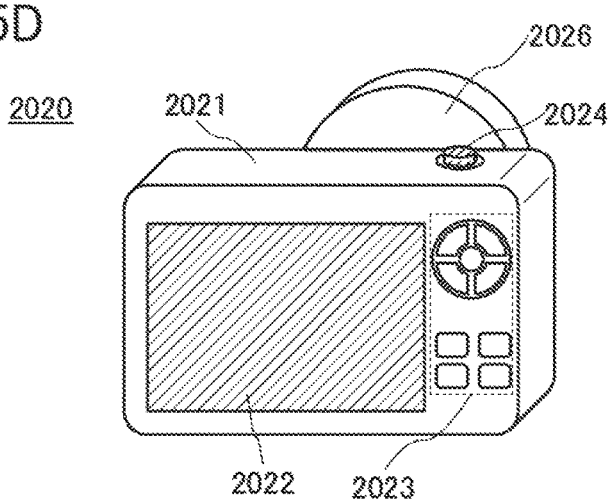

FIG. 25D illustrates an example of a camera. A camera 2020 includes a housing 2021, a display portion 2022, operation buttons 2023, a shutter button 2024, and the like. Furthermore, a detachable lens 2026 is attached to the camera 2020.

Although the lens 2026 of the camera 2020 here is detachable from the housing 2021 for replacement, the lens 2026 may be included in the housing.

Still and moving images can be taken with the camera 2020 at the press of the shutter button 2024. In addition, images can be taken at the touch of the display portion 2022 which serves as a touch panel.

Note that a stroboscope, a viewfinder, and the like can be additionally attached to the camera 2020. Alternatively, these components may be included in the housing 2021.

The system described in the above embodiment can be provided in any of the electronic devices illustrated in FIGS. 25A to 25D.

This embodiment can be combined with any of the other embodiments as appropriate.

This application is based on Japanese Patent Application Serial No. 2016-159948 filed with Japan Patent Office on Aug. 17, 2016, the entire contents of which are hereby incorporated by reference.

What is claimed is:

1. A semiconductor device comprising:

a transmitting portion;

a controller;

an image processing portion;

a driver circuit; and an examination circuit, wherein the controller is configured to control operations of the image processing portion and the examination circuit, wherein the image processing portion is configured to generate a video signal using image data, wherein the driver circuit is configured to output the video signal to a display portion, wherein the examination circuit is configured to examine a degree of variations in characteristics of an element provided in the display portion, wherein examination results are output to the transmitting portion, wherein the examination is performed on the basis of a signal comprising information on the characteristics of the element provided in the display portion, wherein the signal is input from the display portion to the examination circuit, wherein the examination circuit comprises a converter circuit, an evaluation circuit, and a memory device, wherein the converter circuit is configured to convert the signal into a digital signal, wherein the evaluation circuit is configured to calculate a difference between first element characteristics corresponding to the digital signal and second element characteristics used as a reference, and wherein the memory device is configured to store the first element characteristics, the second element characteristics, and data calculated by the evaluation circuit.

2. The semiconductor device according to claim 1, wherein the controller is configured to output the signal to the transmitting portion, and wherein the controller is configured to output image data corrected by the transmitting portion on the basis of the signal to the image processing portion.

3. A display module comprising:

a control portion comprising the semiconductor device according to claim 1; and the display portion, wherein the display portion comprises a light-emitting element and a transistor electrically connected to the light-emitting element, and wherein the examination circuit is configured to examine a degree of variations in threshold voltage of the transistor, field-effect mobility of the transistor, or threshold voltage of the light-emitting element.

4. The display module according to claim 3, wherein the display portion comprises a first pixel group comprising a plurality of first pixels and a second pixel group comprising a plurality of second pixels, wherein the first pixel comprises a reflective liquid crystal element, and wherein the second pixel comprises the light-emitting element.

5. An electronic device comprising:

the display module according to claim 3; and a processor, wherein the processor is configured to correct image data on the basis of the variations in the characteristics of the element provided in the display portion.

6. A display module comprising:

a controller;

an image processing portion;

a driver circuit; and an examination circuit, wherein the controller is configured to control operations of the image processing portion and the examination circuit, wherein the image processing portion is configured to generate a video signal using image data, wherein the driver circuit is configured to output the video signal to a display portion, wherein the examination circuit is configured to examine a degree of variations in characteristics of an element provided in the display portion, wherein examination results are output to an outside of the display module, wherein the examination is performed on the basis of a signal comprising information on the characteristics of the element provided in the display portion, wherein the signal is input from the display portion to the examination circuit, wherein the examination circuit comprises a converter circuit, an evaluation circuit, and a memory device, wherein the converter circuit is configured to convert the signal into a digital signal, wherein the evaluation circuit is configured to calculate a difference between first element characteristics corresponding to the digital signal and second element characteristics used as a reference, and wherein the memory device is configured to store the first element characteristics, the second element characteristics, and data calculated by the evaluation circuit.

7. The display module according to claim 6, wherein the controller is configured to output the signal to a transmitting portion, and wherein the controller is configured to output image data corrected by the transmitting portion on the basis of the signal to the image processing portion.

8. The display module according to claim 6, further comprising:

a control portion; and the display portion, wherein the display portion comprises a light-emitting element and a transistor electrically connected to the light-emitting element, and wherein the examination circuit is configured to examine a degree of variations in threshold voltage of the transistor, field-effect mobility of the transistor, or threshold voltage of the light-emitting element.

9. The display module according to claim 8, wherein the display portion comprises a first pixel group comprising a plurality of first pixels and a second pixel group comprising a plurality of second pixels, wherein the first pixel comprises a reflective liquid crystal element, and wherein the second pixel comprises the light-emitting element.

10. An electronic device comprising:

the display module according to claim 8; and a processor, wherein the processor is configured to correct image data on the basis of the variations in the characteristics of the element provided in the display portion.

* * * * *